US011187080B2

(12) United States Patent
Sollami

(10) Patent No.: US 11,187,080 B2
(45) **Date of Patent: *Nov. 30, 2021**

(54) CONICAL BIT WITH DIAMOND INSERT

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,749

(22) Filed: Apr. 24, 2018

(65) Prior Publication Data

US 2019/0323346 A1 Oct. 24, 2019

(51) Int. Cl.
*E21C 35/183* (2006.01)
*B28D 1/18* (2006.01)

(52) U.S. Cl.
CPC ..... *E21C 35/183* (2013.01); *E21C 35/1831* (2020.05); *E21C 35/1833* (2020.05); *E21C 35/1835* (2020.05); *E21C 35/1837* (2020.05); *B28D 1/186* (2013.01)

(58) Field of Classification Search
CPC ..... E21C 2035/1803; E21C 2035/1809; E21C 2035/1813; E21C 35/18; E21C 35/183; E21C 2035/1806; E21C 2035/1816; B28D 1/186
USPC ..... 299/113, 100–107, 110–111
See application file for complete search history.

(56) References Cited

U.S. PATENT DOCUMENTS

| | | | | |
|---|---|---|---|---|
| 2,382,947 | A | 7/1944 | Brozek | |
| 3,342,532 | A * | 9/1967 | Krekeler | E21C 35/19 175/413 |
| 3,397,012 | A | 8/1968 | Krekeler | |
| 3,476,438 | A | 11/1969 | Bower, Jr. | |
| 3,519,309 | A | 7/1970 | Engle | |
| 3,833,264 | A | 9/1974 | Elders | |
| 3,833,265 | A | 9/1974 | Elders | |
| 3,865,437 | A | 2/1975 | Crosby | |
| 4,084,856 | A | 4/1978 | Emmerich | |
| 4,247,150 | A | 1/1981 | Wrulich et al. | |
| RE30,807 | E | 12/1981 | Elders | |
| 4,310,939 | A | 1/1982 | Iijima | |
| 4,453,775 | A | 6/1984 | Clemmow | |
| 4,478,298 | A | 10/1984 | Hake | |

(Continued)

FOREIGN PATENT DOCUMENTS

| | | | |
|---|---|---|---|
| DE | 2849711 A1 * | 6/1979 | E21C 35/183 |
| DE | 102004049710 | 4/2006 | |

(Continued)

*Primary Examiner* — Janine M Kreck
*Assistant Examiner* — Michael A Goodwin
(74) *Attorney, Agent, or Firm* — Mercedes V. O'Connor; Rockman Videbeck & O'Connor

(57) ABSTRACT

A rotatable or non-rotatable bit for road milling, mining, and trenching equipment that includes a substantially solid body and a substantially solid, generally cylindrical shank depending from a bottom of the body. The bit also includes a forward portion integrally formed at a forward end of the body. The forward portion includes a bore adapted to receive a bit tip insert. Additionally, the bit can also include an insert or transition member disposed within the bore of the forward portion, the insert including a bore adapted to receive the bit tip insert.

38 Claims, 22 Drawing Sheets

(56) References Cited

U.S. PATENT DOCUMENTS 4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A * 10/1987 Sollami ..... E21C 35/183 299/111
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
4,981,328 A 1/1991 Stiffler et al.
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A * 8/2000 Briese ..... E21C 35/183 299/111
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
8,740,314 B2 6/2014 O'Neill
9,004,610 B2 4/2015 Erdmann et al.

(56) References Cited

U.S. PATENT DOCUMENTS 9,028,008 B1 5/2015 Bookhamer
9,039,099 B2 5/2015 Sollami
9,316,061 B2 4/2016 Hall
9,518,464 B2 12/2016 Sollami
9,879,531 B2 1/2018 Sollami
9,909,416 B1 3/2018 Sollami
9,976,418 B2 5/2018 Sollami
9,988,903 B2 6/2018 Sollami
10,072,501 B2 9/2018 Sollami
10,105,870 B1 10/2018 Sollami
10,107,097 B1 10/2018 Sollami
10,107,098 B2 10/2018 Sollami
10,180,065 B1 1/2019 Sollami
10,260,342 B1 4/2019 Sollami
10,323,515 B1 6/2019 Sollami
10,337,324 B2 7/2019 Sollami
10,370,966 B1 8/2019 Sollami
10,385,689 B1 8/2019 Sollami
10,415,386 B1 9/2019 Sollami
10,502,056 B2 12/2019 Sollami
2002/0074850 A1 6/2002 Montgomery, Jr.
2002/0074851 A1 6/2002 Montgomery, Jr.
2002/0109395 A1 8/2002 Sollami
2002/0167216 A1 11/2002 Sollami
2002/0192025 A1 12/2002 Johnson
2003/0015907 A1 1/2003 Sollami
2003/0047985 A1 3/2003 Stiffler
2003/0052530 A1 3/2003 Sollami
2003/0122414 A1* 7/2003 Sollami ..... B28D 1/188 299/113
2003/0209366 A1* 11/2003 McAlvain ..... E21C 35/183 299/113
2004/0004389 A1 1/2004 Latham
2004/0026132 A1* 2/2004 Hall ..... E21C 35/183 175/427
2004/0174065 A1 9/2004 Sollami
2005/0212345 A1 9/2005 Sleep et al.
2006/0071538 A1 4/2006 Sollami
2006/0186724 A1 8/2006 Stehney
2006/0261663 A1 11/2006 Sollami
2007/0013224 A1 1/2007 Stehney
2007/0040442 A1 2/2007 Weaver
2007/0052279 A1 3/2007 Sollami
2008/0035386 A1 2/2008 Hall et al.
2008/0036276 A1 2/2008 Hall et al.
2008/0036283 A1 2/2008 Hall et al.
2008/0042484 A1* 2/2008 Majagi ..... E21C 35/183 299/111
2008/0100124 A1 5/2008 Hall et al.
2008/0145686 A1 6/2008 Mirchandani
2008/0164747 A1 7/2008 Weaver et al.
2008/0284234 A1 11/2008 Hall et al.
2009/0146491 A1 6/2009 Fader et al.
2009/0160238 A1 6/2009 Hall et al.
2009/0256413 A1* 10/2009 Majagi ..... B28D 1/188 299/100
2009/0261646 A1 10/2009 Ritchie et al.
2010/0045094 A1 2/2010 Sollami
2010/0244545 A1 9/2010 Hall
2010/0253130 A1 10/2010 Sollami
2010/0320003 A1 12/2010 Sollami
2010/0320829 A1 12/2010 Sollami
2011/0006588 A1 1/2011 Monyak et al.
2011/0089747 A1 4/2011 Helsel
2011/0175430 A1 7/2011 Heiderich et al.
2011/0204703 A1 8/2011 Sollami
2011/0254350 A1 10/2011 Hall
2012/0001475 A1 1/2012 Dubay et al.
2012/0027514 A1 2/2012 Hall
2012/0056465 A1 3/2012 Gerer et al.
2012/0068527 A1 3/2012 Erdmann
2012/0104830 A1 5/2012 Monyak et al.
2012/0181845 A1 7/2012 Sollami
2012/0242136 A1* 9/2012 Ojanen ..... E21C 35/18 299/105
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2013/0181501 A1 7/2013 Hall et al.
2013/0199693 A1 8/2013 Tank et al.
2013/0307316 A1 11/2013 Roetsch et al.
2014/0035346 A1 2/2014 Fundakowski et al.
2014/0110991 A1* 4/2014 Sollami ..... E21C 35/183 299/79.1
2014/0232172 A1 8/2014 Roth et al.
2014/0262541 A1 9/2014 Parsana et al.
2014/0326516 A1 11/2014 Haugvaldstad
2015/0028656 A1 1/2015 Sollami
2015/0035343 A1* 2/2015 Ojanen ..... B28D 1/186 299/105
2015/0137579 A1 5/2015 Lachmann et al.
2015/0198040 A1* 7/2015 Voitic ..... B23K 1/0008 299/105
2015/0240634 A1* 8/2015 Sollami ..... E21C 35/18 299/102
2015/0285074 A1 10/2015 Sollami
2015/0292325 A1 10/2015 Sollami
2015/0300166 A1 10/2015 Ries et al.
2015/0308488 A1 10/2015 Kahl
2015/0315910 A1 11/2015 Sollami
2015/0354285 A1 12/2015 Hall
2016/0102550 A1 4/2016 Paros et al.
2016/0194956 A1 7/2016 Sollami
2016/0229084 A1 8/2016 Lehnert
2016/0237818 A1 8/2016 Weber et al.
2017/0089198 A1 3/2017 Sollami
2017/0101867 A1 4/2017 Hall et al.
2017/0342831 A1* 11/2017 Weber ..... E21C 35/19
2018/0245467 A1* 8/2018 Kenno ..... E21C 35/183

FOREIGN PATENT DOCUMENTS

DE 102011079115 1/2013
DE 202012100353 6/2013
DE 102015121953 7/2016
DE 102016118658 3/2017
EP 3214261 9/2017
GB 1114156 5/1968
GB 1239142 A * 7/1971 ..... B21K 25/00
GB 2010356 A * 6/1979 ..... E21C 35/183
GB 2483157 2/2012
GB 2534370 7/2016
WO 2008105915 A2 9/2008
WO 2008105915 A3 9/2008
WO 2009006612 1/2009

* cited by examiner

CONICAL BIT WITH DIAMOND INSERT

TECHNICAL FIELD

This disclosure relates to a point attack bit with a diamond bit tip insert used in mining, trenching, and milling equipment.

BACKGROUND

Road mining, trenching, and milling equipment utilizes bits and/or picks traditionally set in a bit assembly. Bit assemblies can include a bit and/or pick retained within a bore in a base bock. Bit assemblies can also include a bit and/or pick retained by a bit holder and the bit holder retained within a bore in a bit holder block, hereinafter referred to as a base block. A plurality of the bit assemblies are mounted on an outside surface of a rotatable, cylindrical drum, typically in a herringbone, V-shape, or spiral configuration. A plurality of the bit assemblies can also be mounted on an endless chain and plate configuration or on an outer surface of a continuous chain. Bit bodies can include a generally conical, parabolic, and/or angular cutting tip that is mounted in a recess in a forward body portion of the bit body. The combinations of bit assemblies have been utilized to remove material from the terra firma, such as degrading the surface of the earth, minerals, cement, concrete, macadam or asphalt pavement. Individual bits and/or picks, bit holders, and base blocks may wear down or break over time due to the harsh road and trenching degrading environment. To prolong the life of the bit assembly, the use of diamond coated and/or layered bit tips and bit tips including an overlay of a polycrystalline diamond structure, such as an industrial diamond material, natural diamond, polycrystalline diamond (PCD) material, and polycrystalline diamond composite or compact (PDC) material, has been shown to increase the in-service life of those bit and/or picks. Additionally, in some cases the forward body portion of the bit and/or pick can be made suitable for cutting conditions that are more abrasive and require a higher hardness forward portion, while in other cases the forward portion can be made suitable for cutting conditions that contain a gaseous environment and require a non-sparking forward portion.

SUMMARY

This disclosure relates generally to a point attack bit for mining, trenching, and/or milling equipment. One implementation of the teachings herein is a tool that includes a body portion and a generally cylindrical shank depending axially from the body portion; and a forward portion integrally attached to the body portion.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Road mining, trenching, and milling equipment utilizes bits and/or picks traditionally set in a bit assembly. Bit assemblies can include a bit and/or pick retained within a bore in a base bock. Bit assemblies can also include a bit and/or pick retained by a bit holder and the bit holder retained within a bore in a bit holder block, hereinafter referred to as a base block. A plurality of the bit assemblies are mounted on an outside surface of a rotatable, cylindrical drum, typically in a herringbone, V-shape, or spiral configuration. A plurality of the bit assemblies can also be mounted on an endless chain and plate configuration or on an outer surface of a continuous chain. Bit bodies can include a generally conical, parabolic, and/or angular cutting tip that is mounted in a recess in a forward body portion of the bit body. The combinations of bit assemblies have been utilized to remove material from the terra firma, such as degrading the surface of the earth, minerals, cement, concrete, macadam or asphalt pavement. Individual bits and/or picks, bit holders, and base blocks may wear down or break over time due to the harsh road degrading environment. To prolong the life of the bit assembly, the use of diamond coated and/or layered bit tips and bit tips including an overlay of a polycrystalline diamond structure, such as an industrial diamond material, natural diamond, polycrystalline diamond (PCD) material, and polycrystalline diamond composite or compact (PDC) material, has been shown to increase the in-service life of those bit and/or picks. Additionally, in some cases the forward body portion of the bit and/or pick can be made suitable for cutting conditions that are more abrasive and require a higher hardness forward portion, while in other cases the forward portion can be made suitable for cutting conditions that contain a gaseous environment and require a non-sparking forward portion.

Figure 1:
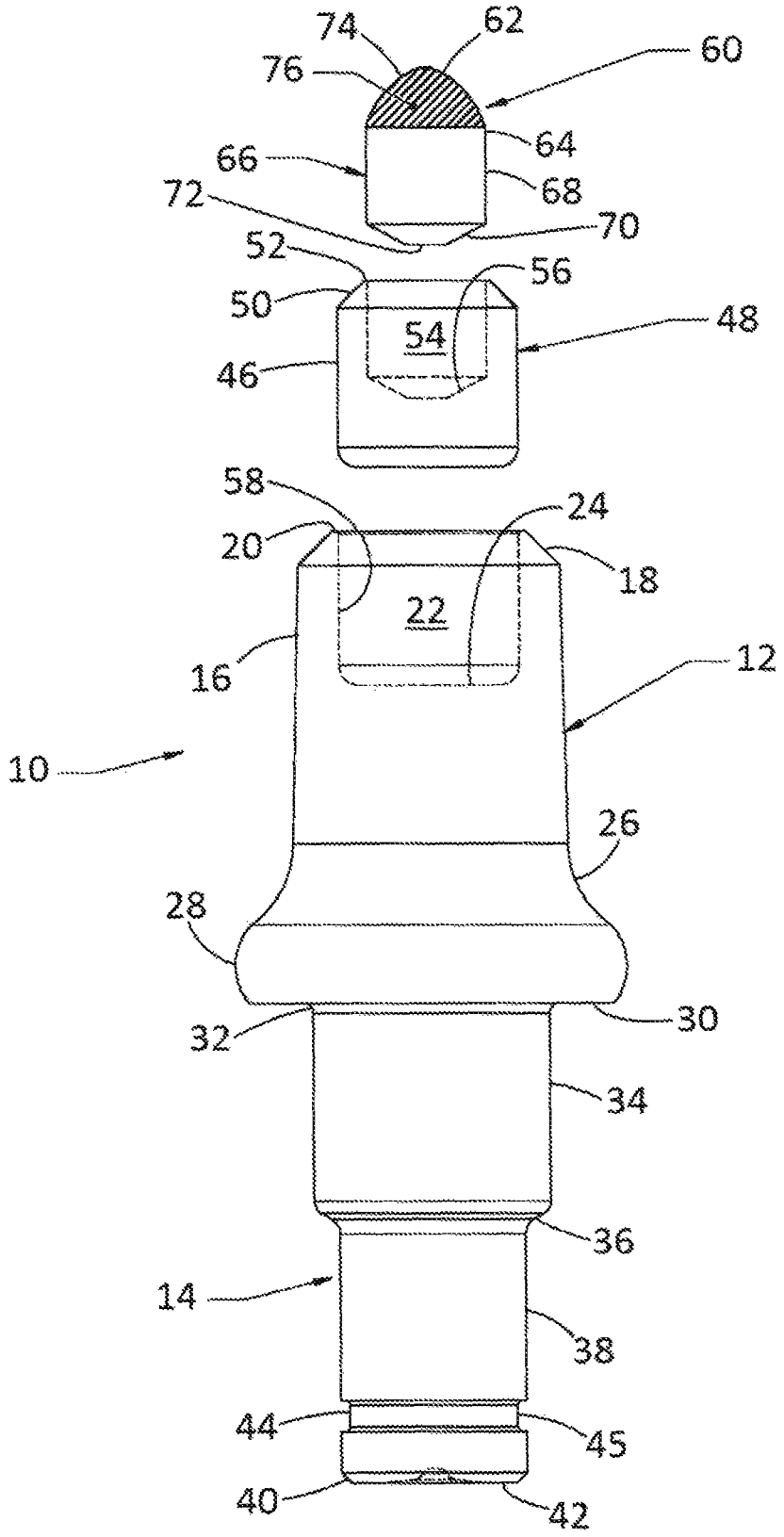
FIG. 1 is an exploded side elevation view of a first embodiment of a bit, showing a bit tip insert and a transition member, in accordance with implementations of this disclosure.
Figure 2:
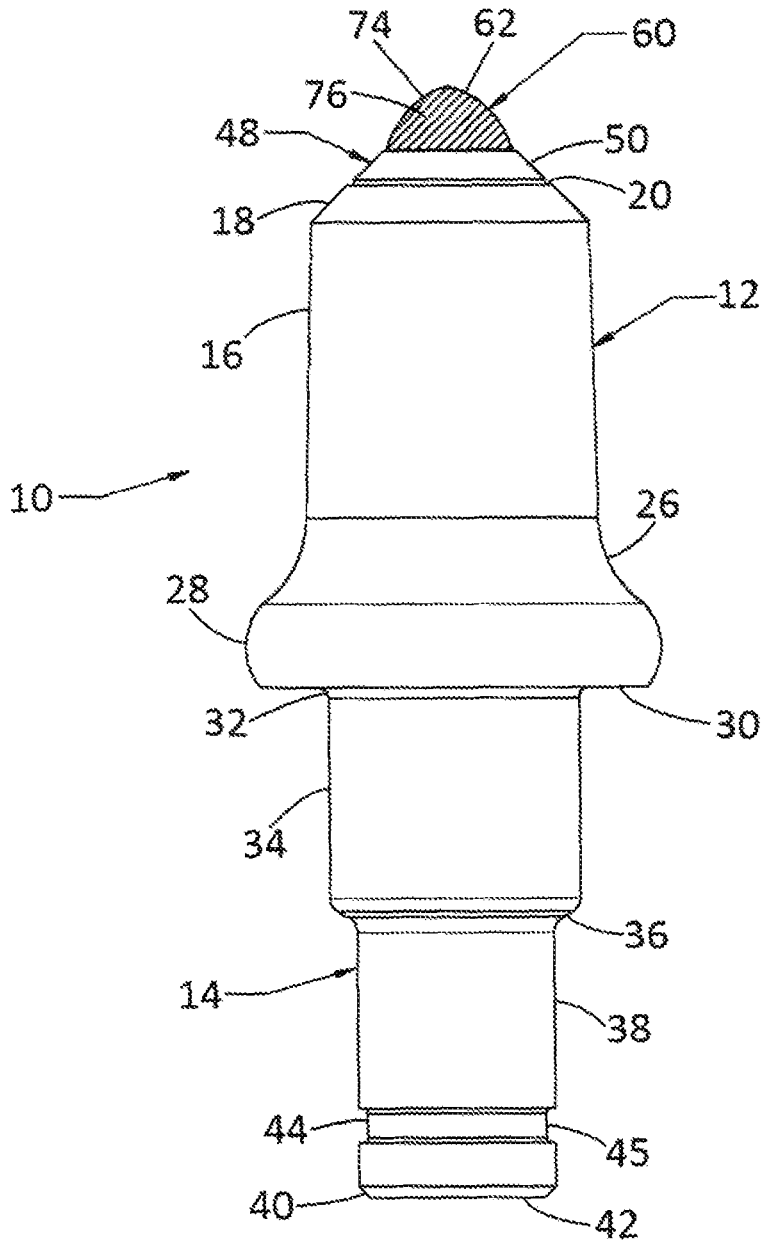
FIG. 2 is a side elevation view of the first embodiment of the bit, shown assembled with the bit tip insert and the transition member, in accordance with implementations of this disclosure.

Referring to FIGS. 1 and 2, a first embodiment of a rotatable or non-rotatable substantially solid bit or tool 10 comprises a body portion 12, which can be made of steel 15B37, 4140, 4340, or other similar suitable materials, and a shank 14 axially extending from a bottom of the body portion 12. The body portion 12 comprises a generally cylindrical or outwardly tapered upper body portion 16 axially depending from a frustoconical portion 18 adjacent a forward end 20 of the body portion 12. A bore 22 extends axially inwardly from the forward end 20 to a bore termination 24 disposed within the upper body portion 16. In this illustrated embodiment, the bore 22 includes a generally cylindrical sidewall 58 and the bore termination 24 is generally flat. Subjacent the upper body portion 16 is a mediate body portion 26 that generally slopes axially and radially outwardly to a radially extending generally arcuate tire portion 28 that terminates at a generally annular back flange 30 that denotes the bottom of the body portion 12.

The shank 14 comprises a first segment 32 that slopes axially and radially inwardly from the back flange 30 to a generally cylindrical second segment 34. The second segment 34 axially extends from the first segment 32 to a shoulder 36 that slopes axially and radially inwardly from the second segment 34 to a generally cylindrical third segment 38. The third segment 38 axially extends from the shoulder 36 to a tapered distal portion 40 adjacent a distal end 42 of the shank 14. The third segment 38 comprises an annular groove 44, which in this illustrated embodiment has an flat inner surface 45 but can also have an arcuate surface in other embodiments, adjacent the tapered distal portion 40 of the shank 14 where it can be engaged by a bit retainer or the like.

The generally cylindrical bore 22 provides a space for receiving a complementary shaped generally cylindrical outer surface or body 46 of an insert or transition member 48, which in this embodiment is made of tungsten carbide. The transition member 48 comprises a frustoconical portion 50 subjacent a forward end 52 of the transition member 48 that axially extends to the body 46. The transition member 48 further comprises a bore 54, which is generally cylindrical in this embodiment, that extends axially inwardly from the forward end 52 of the transition member 48 to a bore termination 56 disposed within the body 46 of the transition member 48. In this illustrated embodiment, the bore termination 56 has a frustoconical shape. The transition member 48 for the bit 10 extends axially upwardly longitudinally from the forward end 20 of the body portion 12 when the body 46 is placed in the complementary shaped bore 22 of the body portion 12.

A bit tip insert 60 comprises a generally conical tip 62 at a forward end 64 of a base 66 that includes a parabolic curved section below an apex of the tip insert 60. The tip 62 can also have a frustoconical shape, a flat generally cylindrical puck shape, a parabolic ballistic shape, an angular shape, and/or an arcuate shape. In one exemplary implementation of the first embodiment, the tip insert 60 can have a diameter in the range of ⅝ inch to 1.250 inch. The base 66 comprises a complementary shaped generally cylindrical outer surface or sidewall 68 that is adapted to be mounted in the complementary shaped bore 54 that provides a space for receiving the bit tip insert 60. In this first embodiment, the base 66 includes a frustoconical portion 70, adjacent a distal end 72 of the base 66, which is complementary shaped to the bore termination 56 of the transition member 48. The sidewall 68 of the base 66 may require grinding. The frustoconical portion 70 and the distal end 72 do not require additional finishing processes, such as grinding. The base 66 may be made of steel or tungsten carbide and includes the tip 62 at the outer or forward end 64 of the base 66.

In this embodiment, the tip 62 comprises a substrate (not shown) that is primarily made of tungsten carbide and comprises an outer surface or forward end 74 that includes an overlay 76 of a polycrystalline diamond structure. The outer surface 74 of the tip 62 may also have an overlay 76 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 62 and the forward end 64 of the base 66. The excess PCD material can be used as formed on tools that are used in milling, trenching, mining, and similar applications. The overlay 76 occupies a large radial and axial profile of the tip 62 which allows faster heat transfer into a region subjacent to the overlay 76 PCD layer. Excessively high heat, such as temperatures above 1300 degrees F., is the greatest cause of PCD failure due to diamond connective failure, the quick heat transfer from the tip 62 of the PCD cutting zone to the subjacent region below the PCD drastically reduces the possibility of a temperature of the tip 62 of the PCD reaching temperatures at or above 1300 degrees F. for any extended period of time thereby avoiding failure of the PCD layer. To assemble the bit or tool 10 into a unitary piece, the transition member 48 is brazed in bore 22 of the body portion 12 and the bit tip insert 60 is brazed in the bore 54 of the transition member 48, as shown in FIG. 2.

Figure 3:
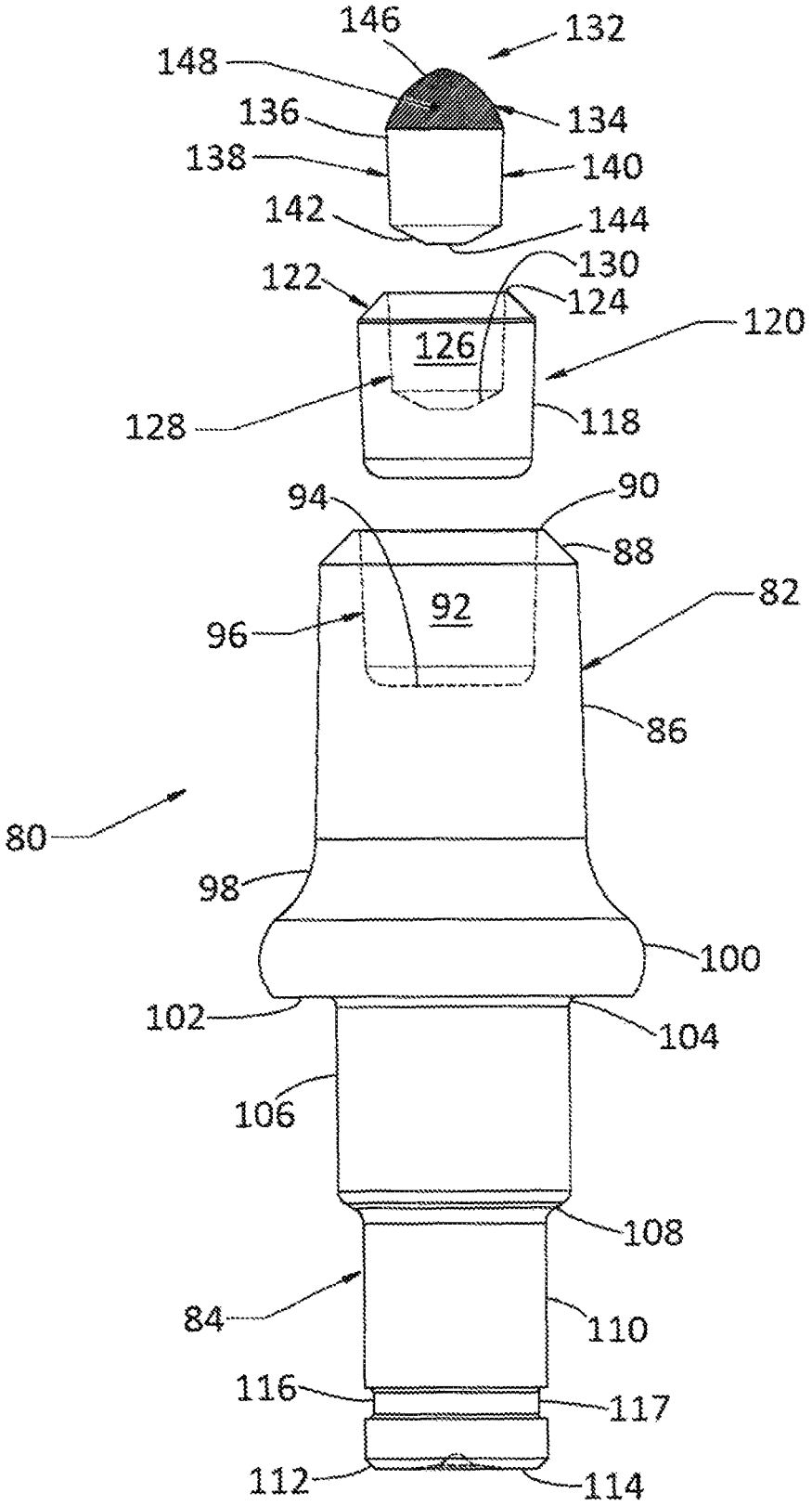
FIG. 3 is an exploded side elevation view of a second embodiment of a bit, showing a bit tip insert and a transition member, in accordance with implementations of this disclosure.
Figure 4:
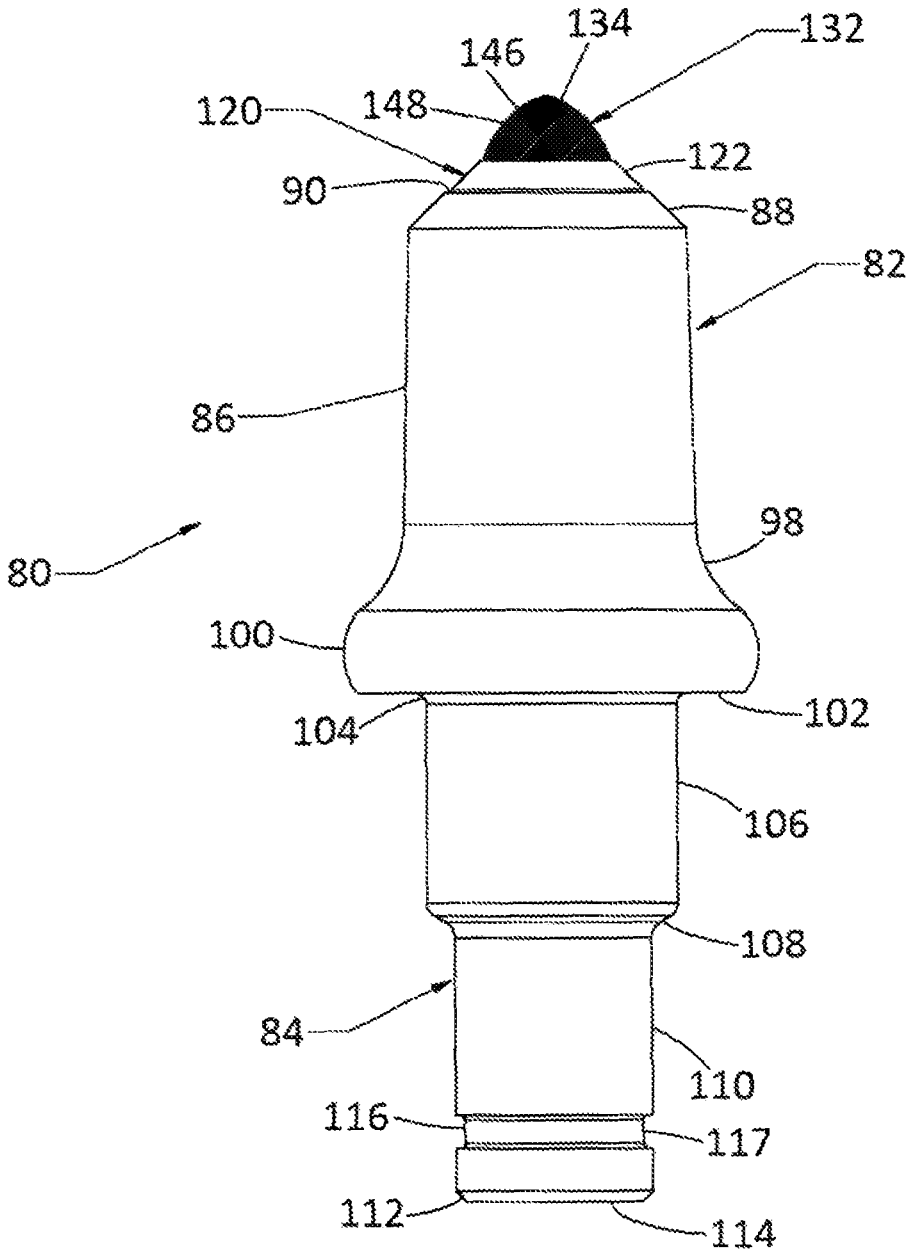
FIG. 4 is a side elevation view of the second embodiment of the bit, shown assembled with the bit tip insert and the transition member, in accordance with implementations of this disclosure.

Referring to FIGS. 3 and 4, a second embodiment of a rotatable or non-rotatable substantially solid bit or tool 80 comprises a body portion 82, which can be made of steel 15B37, 4140, 4340, or other similar suitable materials, and a shank 84 axially extending from a bottom of the body portion 82. The body portion 82 comprises a generally cylindrical or outwardly tapered upper body portion 86 axially depending from a frustoconical portion 88 adjacent a forward end 90 of the body portion 82. A bore 92 extends axially inwardly from the forward end 90 to a bore termination 94 disposed within the upper body portion 86. In this illustrated embodiment, the bore 92 includes a tapered sidewall 96 and the bore termination 24 is generally flat. Subjacent the upper body portion 86 is a mediate body portion 98 that generally slopes axially and radially outwardly to a radially extending generally arcuate tire portion 100 that terminates at a generally annular back flange 102 that denotes the bottom of the body portion 82.

The shank 84 comprises a first segment 104 that slopes axially and radially inwardly from the back flange 102 to a generally cylindrical second segment 106. The second segment 106 axially extends from the first segment 104 to a shoulder 108 that slopes axially and radially inwardly from the second segment 106 to a generally cylindrical third segment 110. The third segment 110 axially extends from the shoulder 108 to a tapered distal portion 112 adjacent a distal end 114 of the shank 84. The third segment 110 comprises an annular groove 116, which in this illustrated embodiment has an flat inner surface 117 but can also have an arcuate surface in other embodiments, adjacent the tapered distal portion 112 of the shank 84 where it can be engaged by a bit retainer or the like.

The tapered bore 92 provides a space for receiving a complementary shaped tapered outer surface or body 118 of an insert or transition member 120, which in this embodiment is made of tungsten carbide. The transition member 120 comprises a frustoconical portion 122 subjacent a forward end 124 of the transition member 120 that axially extends to the body 118. The transition member 120 further comprises a bore 126, which includes a tapered sidewall 128 in this embodiment, that extends axially inwardly from the forward end 124 of the transition member 120 to a bore termination 130 disposed within the body 118 of the transition member 120. In this illustrated embodiment, the bore termination 130 has a frustoconical shape. The transition member 120 for the bit 80 extends axially upwardly longitudinally from the forward end 90 of the body portion 82 when the body 118 is placed in the complementary shaped bore 92 of the body portion 82.

A bit tip insert 132 comprises a generally conical tip 134 at a forward end 136 of a base 138 that includes a parabolic curved section below an apex of the tip insert 132. The tip 134 can also have a frustoconical shape, a flat generally cylindrical puck shape, a parabolic ballistic shape, an angular shape, and/or an arcuate shape. In one exemplary implementation of the second embodiment, the tip insert 132 can have a diameter in the range of ⅝ inch to 1.250 inch. The base 138 comprises a complementary shaped tapered outer surface or sidewall 140 that is adapted to be mounted in the complementary shaped bore 126 that provides a space for receiving the bit tip insert 132. In this second embodiment, the base 138 includes a frustoconical portion 142, adjacent a distal end 144 of the base 138, which is complementary shaped to the bore termination 130 of the transition member 120. The sidewall 140 of the base 138 may require grinding. The frustoconical portion 142 and the distal end 144 do not require additional finishing processes, such as grinding. The base 138 may be made of steel or tungsten carbide and includes the tip 134 at the outer or forward end 136 of the base 138.

In this embodiment, the tip 134 comprises a substrate (not shown) that is primarily made of tungsten carbide and comprises an outer surface or forward end 146 that includes an overlay 148 of a polycrystalline diamond structure. The outer surface 146 of the tip 134 may also have an overlay 148 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 134 and the forward end 136 of the base 138. The excess PCD material can be used as formed on tools that are used in milling, trenching, mining, and similar applications. The overlay 148 occupies a large radial and axial profile of the tip 134 which allows faster heat transfer into a region subjacent to the overlay 148 PCD layer. Excessively high heat, such as temperatures above 1300 degrees F., is the greatest cause of PCD failure due to diamond connective failure, the quick heat transfer from the tip 134 of the PCD cutting zone to the subjacent region below the PCD drastically reduces the possibility of a temperature of the tip 134 of the PCD reaching temperatures at or above 1300 degrees F. for any extended period of time thereby avoiding failure of the PCD layer. To assemble the bit or tool 80 into a unitary piece, the transition member 120 is brazed in bore 92 of the body portion 82 and the bit tip insert 132 is brazed in the bore 126 of the transition member 120, as shown in FIG. 4.

Figure 5:
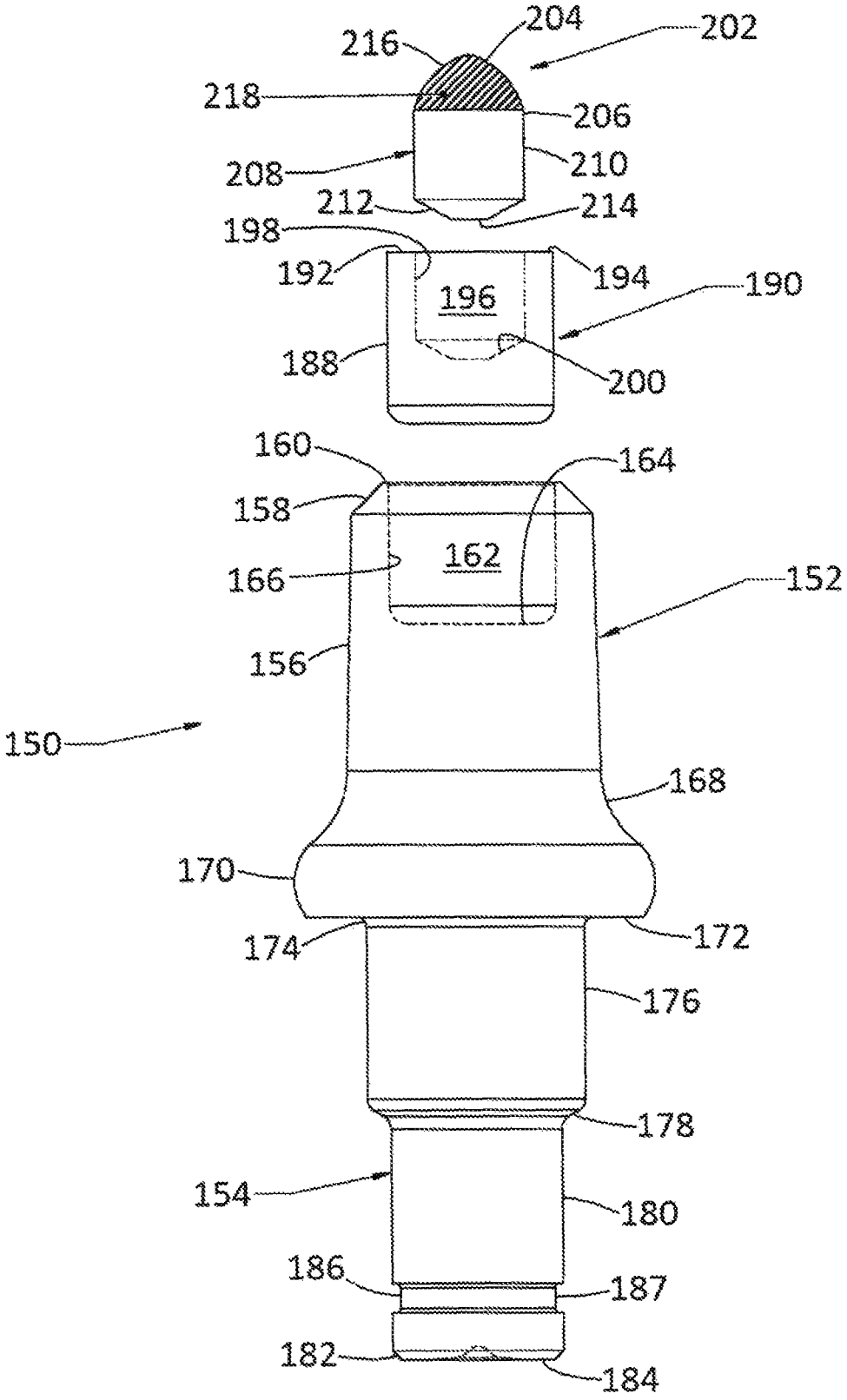
FIG. 5 is an exploded side elevation view of a third embodiment of a bit, showing a bit tip insert and a transition member, in accordance with implementations of this disclosure.
Figure 6:
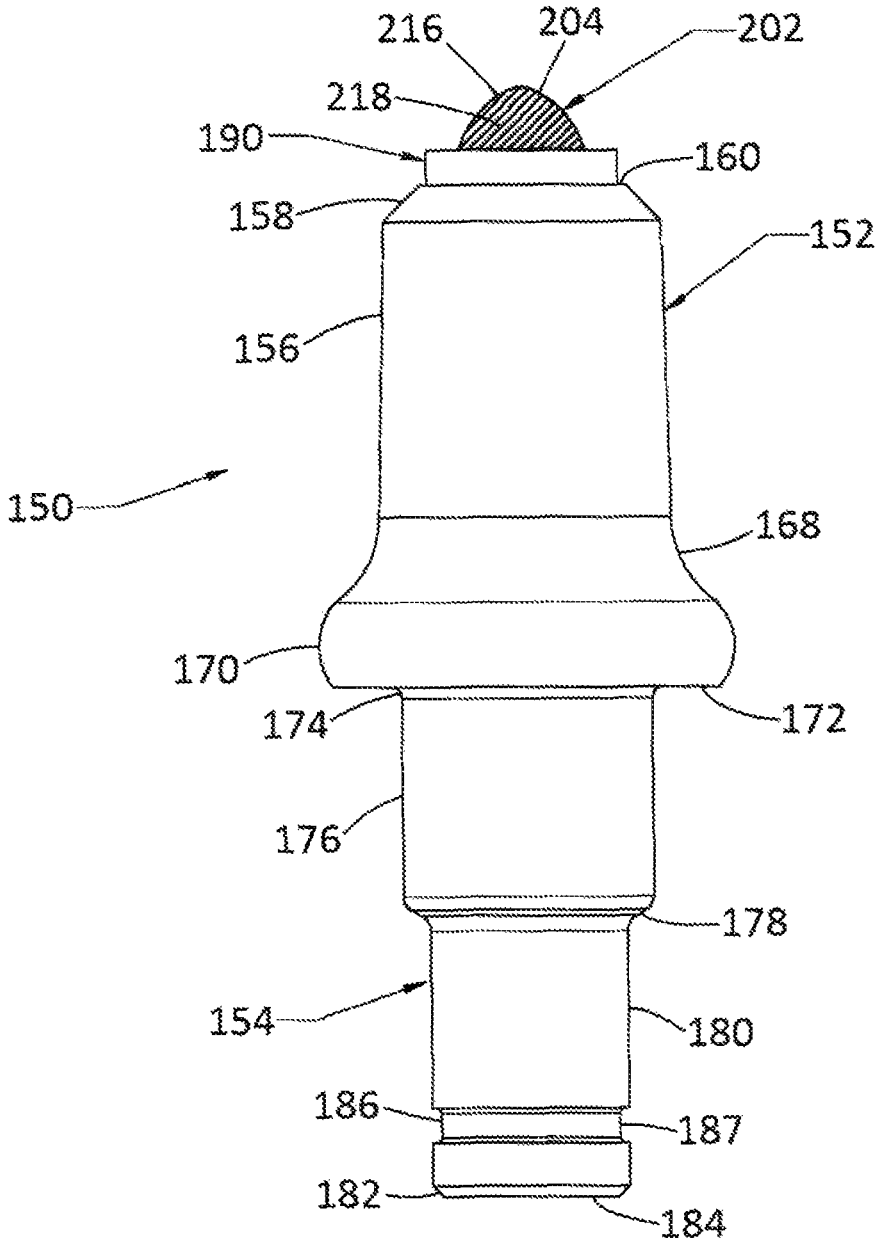
FIG. 6 is a side elevation view of the third embodiment of the bit, shown assembled with the bit tip insert and the transition member, in accordance with implementations of this disclosure.

Referring to FIGS. 5 and 6, a third embodiment of a rotatable or non-rotatable substantially solid bit or tool 150 comprises a body portion 152, which can be made of steel 15B37, 4140, 4340, or other similar suitable materials, and a shank 154 axially extending from a bottom of the body portion 152. The body portion 152 comprises a generally cylindrical or outwardly tapered upper body portion 156 axially depending from a frustoconical portion 158 adjacent a forward end 160 of the body portion 152. A bore 162 extends axially inwardly from the forward end 160 to a bore termination 164 disposed within the upper body portion 156. In this illustrated embodiment, the bore 162 includes a generally cylindrical sidewall 166 and the bore termination 164 is generally flat. Subjacent the upper body portion 156 is a mediate body portion 168 that generally slopes axially and radially outwardly to a radially extending generally arcuate tire portion 170 that terminates at a generally annular back flange 172 that denotes the bottom of the body portion 152.

The shank 154 comprises a first segment 174 that slopes axially and radially inwardly from the back flange 172 to a generally cylindrical second segment 176. The second segment 176 axially extends from the first segment 174 to a shoulder 178 that slopes axially and radially inwardly from the second segment 176 to a generally cylindrical third segment 180. The third segment 180 axially extends from the shoulder 178 to a tapered distal portion 182 adjacent a distal end 184 of the shank 154. The third segment 180 comprises an annular groove 186, which in this illustrated embodiment has an flat inner surface 187 but can also have an arcuate surface in other embodiments, adjacent the tapered distal portion 182 of the shank 154 where it can be engaged by a bit retainer or the like.

The generally cylindrical bore 162 provides a space for receiving a complementary shaped generally cylindrical outer surface or body 188 of an insert or transition member 190, which in this embodiment is made of tungsten carbide. The body 188 of the transition member 190 axially extends from an interface 192, such as a flat annular or generally cylindrical surface in this exemplary embodiment, that defines a forward end 194 of the transition member 190. The transition member 190 further comprises a bore 196, which includes a generally cylindrical sidewall 198 in this embodiment, that extends axially inwardly from the forward end 194 of the transition member 190 to a bore termination 200 disposed within the body 188 of the transition member 190. In this illustrated embodiment, the bore termination 200 has a frustoconical shape. The transition member 190 for the bit 150 extends axially upwardly longitudinally from the forward end 160 of the body portion 152 when the body 188 is placed in the complementary shaped bore 162 of the body portion 152.

A bit tip insert 202 comprises a generally conical tip 204 at a forward end 206 of a base 208 that includes a parabolic curved section below an apex of the tip insert 202. The tip 204 can also have a frustoconical shape, a flat generally cylindrical puck shape, a parabolic ballistic shape, an angular shape, and/or an arcuate shape. In one exemplary implementation of the third embodiment, the tip insert 202 can have a diameter in the range of ⅝ inch to 1.250 inch. The base 208 comprises a complementary shaped generally cylindrical outer surface or sidewall 210 that is adapted to be mounted in the complementary shaped bore 196 that provides a space for receiving the bit tip insert 202. In this third embodiment, the base 208 includes a frustoconical portion 212, adjacent a distal end 214 of the base 208, which is complementary shaped to the bore termination 200 of the transition member 190. The sidewall 210 of the base 208 may require grinding. The frustoconical portion 212 and the distal end 214 do not require additional finishing processes, such as grinding. The base 208 may be made of steel or tungsten carbide and includes the tip 204 at the outer or forward end 206 of the base 208.

In this embodiment, the tip 204 comprises a substrate (not shown) that is primarily made of tungsten carbide and comprises an outer surface or forward end 216 that includes an overlay 218 of a polycrystalline diamond structure. The outer surface 216 of the tip 204 may also have an overlay 218 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 204 and the forward end 206 of the base 208. The excess PCD material can be used as formed on tools that are used in milling, trenching, mining, and similar applications. The overlay 218 occupies a large radial and axial profile of the tip 204 which allows faster heat transfer into a region subjacent to the overlay 218 PCD layer. Excessively high heat, such as temperatures above 1300 degrees F., is the greatest cause of PCD failure due to diamond connective failure, the quick heat transfer from the tip 204 of the PCD cutting zone to the subjacent region below the PCD drastically reduces the possibility of a temperature of the tip 204 of the PCD reaching temperatures at or above 1300 degrees F. for any extended period of time thereby avoiding failure of the PCD layer. To assemble the bit or tool 150 into a unitary piece, the transition member 190 is brazed in bore 162 of the body portion 152 and the bit tip insert 202 is brazed in the bore 196 of the transition member 190, as shown in FIG. 6.

Figure 7:
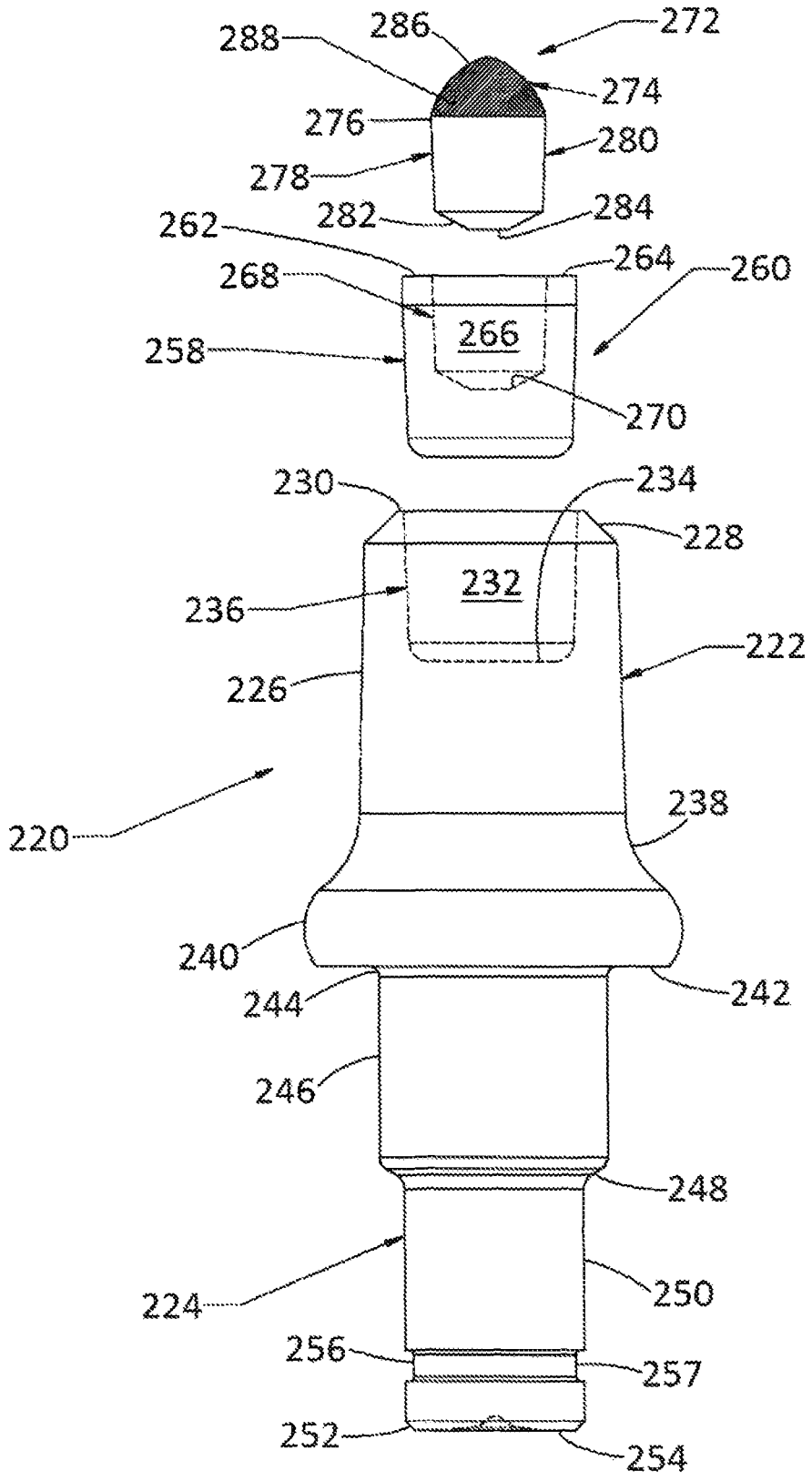
FIG. 7 is an exploded side elevation view of a fourth embodiment of a bit, showing a bit tip insert and a transition member, in accordance with implementations of this disclosure.
Figure 8:
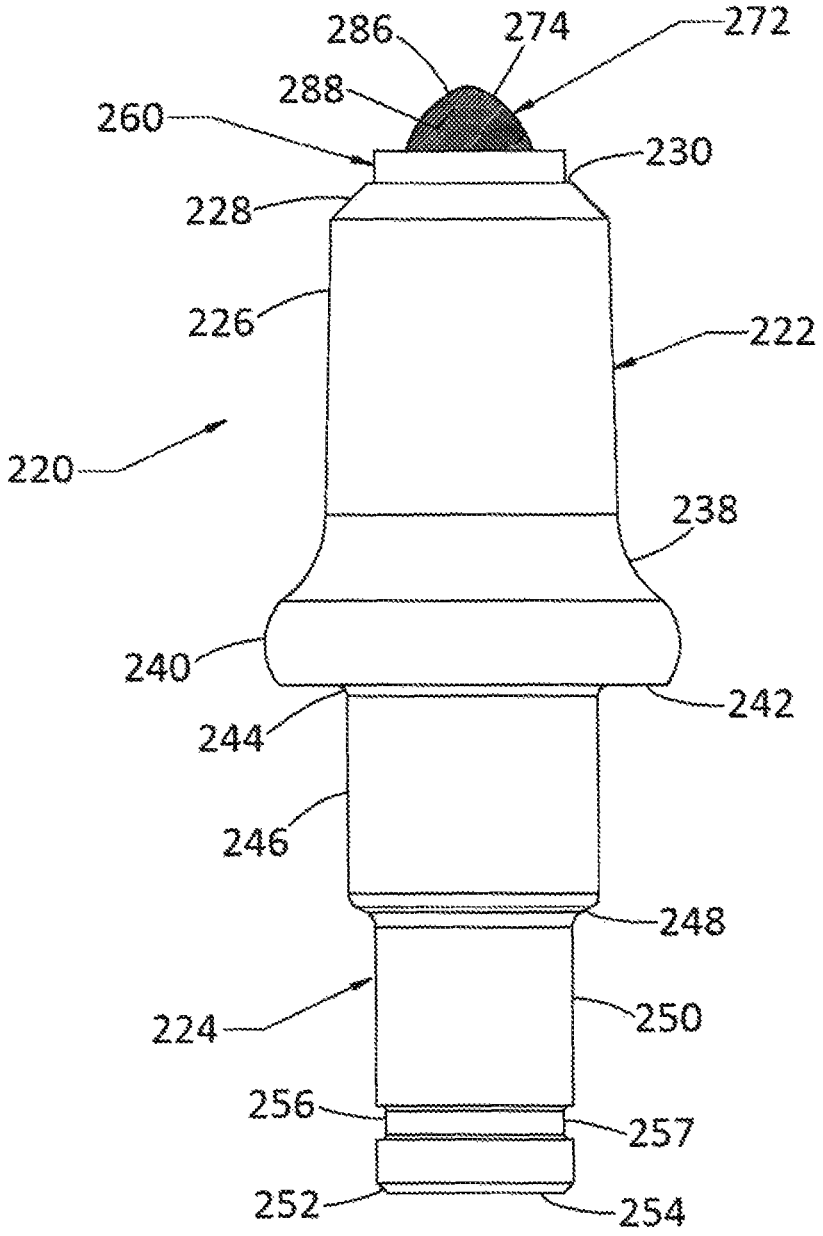
FIG. 8 is a side elevation view of the fourth embodiment of the bit, shown assembled with the bit tip insert and the transition member, in accordance with implementations of this disclosure.

Referring to FIGS. 7 and 8, a fourth embodiment of a rotatable or non-rotatable substantially solid bit or tool 220 comprises a body portion 222, which can be made of steel 15B37, 4140, 4340, or other similar suitable materials, and a shank 224 axially extending from a bottom of the body portion 222. The body portion 222 comprises a generally cylindrical or outwardly tapered upper body portion 226 axially depending from a frustoconical portion 228 adjacent a forward end 230 of the body portion 222. A bore 232 extends axially inwardly from the forward end 230 to a bore termination 234 disposed within the upper body portion 226. In this illustrated embodiment, the bore 232 includes a tapered sidewall 236 and the bore termination 234 is generally flat. Subjacent the upper body portion 226 is a mediate body portion 238 that generally slopes axially and radially outwardly to a radially extending generally arcuate tire portion 240 that terminates at a generally annular back flange 242 that denotes the bottom of the body portion 222.

The shank 224 comprises a first segment 244 that slopes axially and radially inwardly from the back flange 242 to a generally cylindrical second segment 246. The second segment 246 axially extends from the first segment 244 to a shoulder 248 that slopes axially and radially inwardly from the second segment 246 to a generally cylindrical third segment 250. The third segment 250 axially extends from the shoulder 248 to a tapered distal portion 252 adjacent a distal end 254 of the shank 224. The third segment 250 comprises an annular groove 256, which in this illustrated embodiment has an flat inner surface 257 but can also have an arcuate surface in other embodiments, adjacent the tapered distal portion 252 of the shank 224 where it can be engaged by a bit retainer or the like.

The tapered bore 232 provides a space for receiving a complementary shaped tapered outer surface or body 258 of an insert or transition member 260, which in this embodiment is made of tungsten carbide. The body 258 of the transition member 260 axially extends from an interface 262, such as a flat annular or generally cylindrical surface in this exemplary embodiment, that defines a forward end 264 of the transition member 260. The transition member 260 further comprises a bore 266, which includes a tapered sidewall 268 in this embodiment, that extends axially inwardly from the forward end 264 of the transition member 260 to a bore termination 270 disposed within the body 258 of the transition member 260. In this illustrated embodiment, the bore termination 270 has a frustoconical shape. The transition member 260 for the bit 220 extends axially upwardly longitudinally from the forward end 230 of the body portion 222 when the body 258 is placed in the complementary shaped bore 232 of the body portion 222.

A bit tip insert 272 comprises a generally conical tip 274 at a forward end 276 of a base 278 that includes a parabolic curved section below an apex of the tip insert 272. The tip 274 can also have a frustoconical shape, a flat generally cylindrical puck shape, a parabolic ballistic shape, an angular shape, and/or an arcuate shape. In one exemplary implementation of the fourth embodiment, the tip insert 272 can have a diameter in the range of ⅝ inch to 1.250 inch. The base 278 comprises a complementary shaped tapered outer surface or sidewall 280 that is adapted to be mounted in the complementary shaped bore 266 that provides a space for receiving the bit tip insert 272. In this fourth embodiment, the base 278 includes a frustoconical portion 282, adjacent a distal end 284 of the base 278, which is complementary shaped to the bore termination 270 of the transition member 260. The sidewall 280 of the base 278 may require grinding. The frustoconical portion 282 and the distal end 284 do not require additional finishing processes, such as grinding. The base 278 may be made of steel or tungsten carbide and includes the tip 274 at the outer or forward end 276 of the base 278.

In this embodiment, the tip 274 comprises a substrate (not shown) that is primarily made of tungsten carbide and comprises an outer surface or forward end 286 that includes an overlay 288 of a polycrystalline diamond structure. The outer surface 286 of the tip 274 may also have an overlay 288 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 274 and the forward end 276 of the base 278. The excess PCD material can be used as formed on tools that are used in milling, trenching, mining, and similar applications. The overlay 288 occupies a large radial and axial profile of the tip 274 which allows faster heat transfer into a region subjacent to the overlay 288 PCD layer. Excessively high heat, such as temperatures above 1300 degrees F., is the greatest cause of PCD failure due to diamond connective failure, the quick heat transfer from the tip 274 of the PCD cutting zone to the subjacent region below the PCD drastically reduces the possibility of a temperature of the tip 274 of the PCD reaching temperatures at or above 1300 degrees F. for any extended period of time thereby avoiding failure of the PCD layer. To assemble the bit or tool 220 into a unitary piece, the transition member 260 is brazed in bore 232 of the body portion 222 and the bit tip insert 272 is brazed in the bore 266 of the transition member 260, as shown in FIG. 8.

Figure 9:
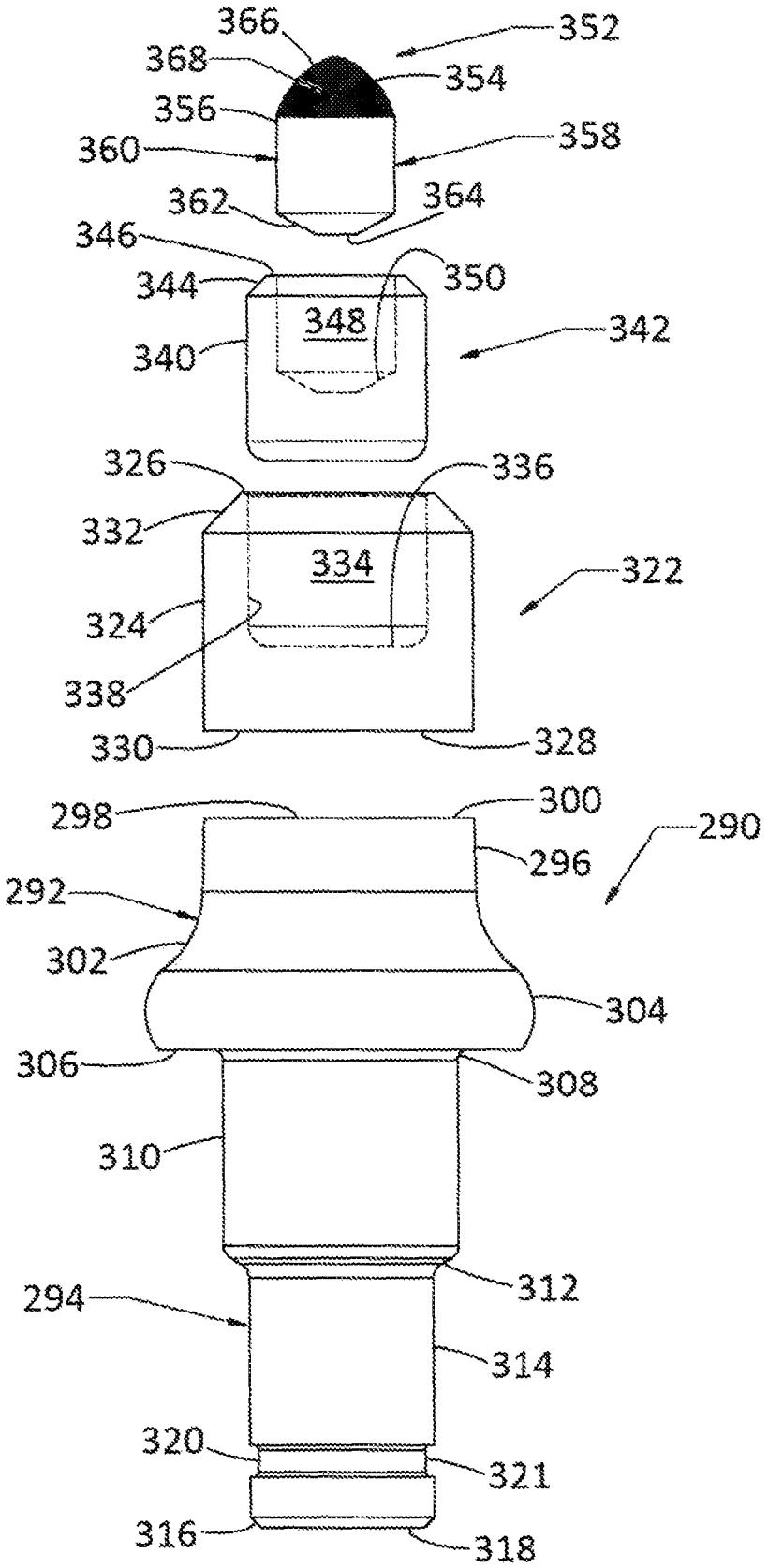
FIG. 9 is an exploded side elevation view of a fifth embodiment of a bit, showing a forward portion of the bit prior to welding, a bit tip insert, and a transition member, in accordance with implementations of this disclosure.
Figure 10:
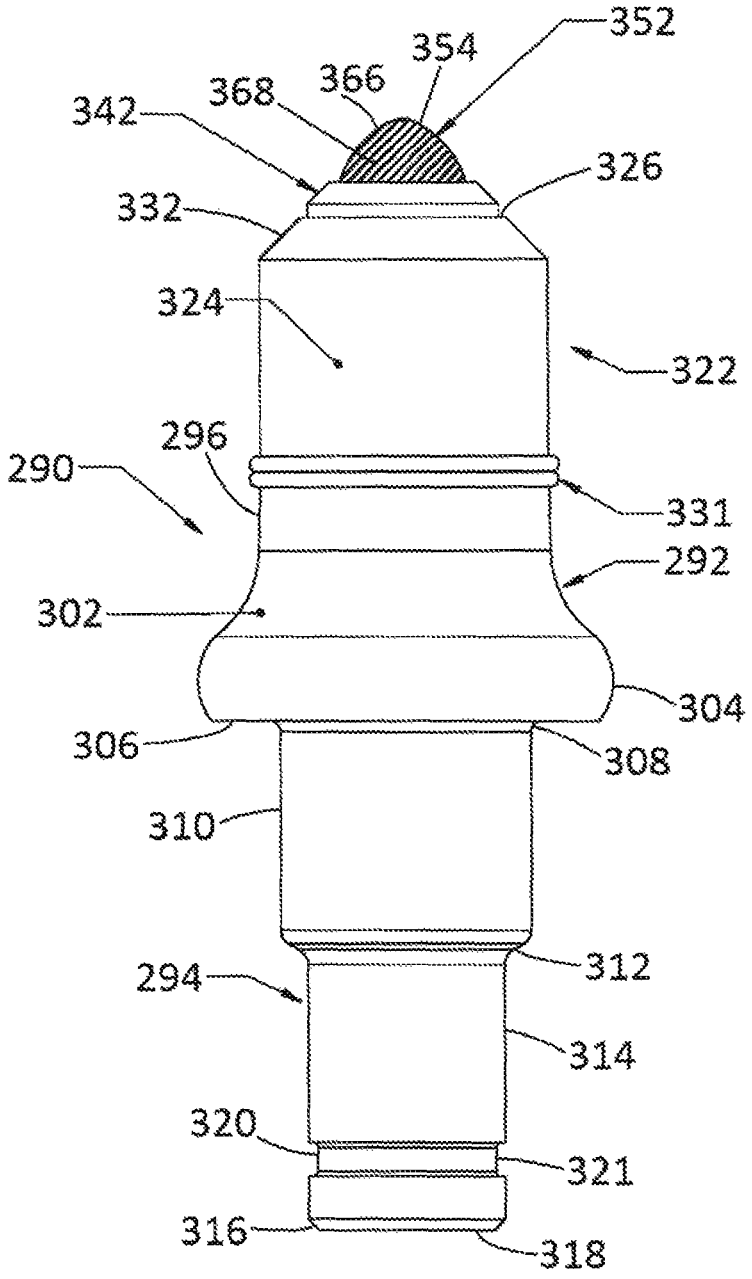
FIG. 10 is a side elevation view of the fifth embodiment of the bit, shown after welding the forward portion to the bit and assembled with the bit tip insert and the transition member, in accordance with implementations of this disclosure.

Referring to FIGS. 9 and 10, a fifth embodiment of a rotatable or non-rotatable substantially solid bit or tool 290 comprises a body portion 292, which can be made of steel 15B37, 4140, 4340, or other similar suitable materials, and a shank 294 axially extending from a bottom of the body portion 292. The body portion 292 comprises a generally cylindrical or outwardly tapered upper body portion 296 axially depending from an interface 298, such as a flat annular or generally cylindrical surface in this exemplary embodiment, that defines a forward end 300 of the body portion 292. Subjacent the upper body portion 296 is a mediate body portion 302 that generally slopes axially and radially outwardly to a radially extending generally arcuate tire portion 304 that terminates at a generally annular back flange 306 that denotes the bottom of the body portion 292.

The shank 294 comprises a first segment 308 that slopes axially and radially inwardly from the back flange 306 to a generally cylindrical second segment 310. The second segment 310 axially extends from the first segment 308 to a shoulder 312 that slopes axially and radially inwardly from the second segment 310 to a generally cylindrical third segment 314. The third segment 314 axially extends from the shoulder 312 to a tapered distal portion 316 adjacent a distal end 318 of the shank 294. The third segment 314 comprises an annular groove 320, which in this illustrated embodiment has an flat inner surface 321 but can also have an arcuate surface in other embodiments, adjacent the tapered distal portion 316 of the shank 294 where it can be engaged by a bit retainer or the like.

A forward body or nose portion 322, which can be made of steel 15B47, 4140, 4340, or other similar suitable materials and/or high wear, abrasive resistant, high strength alloy steel with a KSI strength in excess of 200 KSI, comprises a body 324 that axially extends from a forward end 326 to an interface 328, such as a flat annular or generally cylindrical surface in this exemplary embodiment, defining a distal end 330 of the forward body portion 322. The interface 328 of the forward body portion 322 is friction welded to the interface 298 of the body portion 292 of the bit 290, which forms a friction welded joint 331 (FIG. 10) between the forward body portion 322 and the body portion 292. The forward body portion 322 further includes a frustoconical portion 332 adjacent the forward end 326 and a bore 334 that extends axially inwardly from the forward end 322 to a bore termination 336 disposed within the forward body portion 332. In this illustrated embodiment, the bore 334 includes a generally cylindrical sidewall 338 and the bore termination 336 is generally flat.

The generally cylindrical bore 334 provides a space for receiving a complementary shaped generally cylindrical outer surface or body 340 of an insert or transition member 342, which in this embodiment is made of tungsten carbide. The transition member 342 comprises a frustoconical portion 344 subjacent a forward end 346 of the transition member 342 that axially extends to the body 340. The transition member 342 further comprises a bore 348, which is generally cylindrical in this embodiment, that extends axially inwardly from the forward end 346 of the transition member 342 to a bore termination 350 disposed within the body 340 of the transition member 342. In this illustrated embodiment, the bore termination 350 has a frustoconical shape. The transition member 342 for the bit 290 extends axially upwardly longitudinally from the forward end 326 of the forward body portion 322 when the body 340 is placed in the complementary shaped bore 334 of the forward body portion 322.

A bit tip insert 352 comprises a generally conical tip 354 at a forward end 356 of a base 358 that includes a parabolic curved section below an apex of the tip insert 352. The tip 354 can also have a frustoconical shape, a flat generally cylindrical puck shape, a parabolic ballistic shape, an angular shape, and/or an arcuate shape. In one exemplary implementation of the fifth embodiment, the tip insert 352 can have a diameter in the range of ⅝ inch to 1.250 inch. The base 358 comprises a complementary shaped generally cylindrical outer surface or sidewall 360 that is adapted to be mounted in the complementary shaped bore 348 that provides a space for receiving the bit tip insert 352. In this fifth embodiment, the base 358 includes a frustoconical portion 362, adjacent a distal end 364 of the base 358, which is complementary shaped to the bore termination 350 of the transition member 342. The sidewall 360 of the base 358 may require grinding. The frustoconical portion 362 and the distal end 364 do not require additional finishing processes, such as grinding. The base 358 may be made of steel or tungsten carbide and includes the tip 354 at the outer or forward end 356 of the base 358.

In this embodiment, the tip 354 comprises a substrate (not shown) that is primarily made of tungsten carbide and comprises an outer surface or forward end 366 that includes an overlay 368 of a polycrystalline diamond structure. The outer surface 366 of the tip 354 may also have an overlay 368 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 354 and the forward end 356 of the base 358. The excess PCD material can be used as formed on tools that are used in milling, trenching, mining, and similar applications. The overlay 368 occupies a large radial and axial profile of the tip 354 which allows faster heat transfer into a region subjacent to the overlay 368 PCD layer. Excessively high heat, such as temperatures above 1300 degrees F., is the greatest cause of PCD failure due to diamond connective failure, the quick heat transfer from the tip 354 of the PCD cutting zone to the subjacent region below the PCD drastically reduces the possibility of a temperature of the tip 354 of the PCD reaching temperatures at or above 1300 degrees F. for any extended period of time thereby avoiding failure of the PCD layer. To assemble the bit or tool 290 into a unitary piece, the interface 328 of the forward body portion 322 is friction welded to the interface 298 of the body portion 292 of the bit 290. Then, the transition member 342 is brazed in bore 334 of the forward body portion 322 and the bit tip insert 352 is brazed in the bore 348 of the transition member 342, as shown in FIG. 10. The bit tip insert 832 may also be brazed to the transition member 342 and the transition member 342 may also be brazed to the forward body portion 322 and then hardened prior friction welding.

Figure 11:
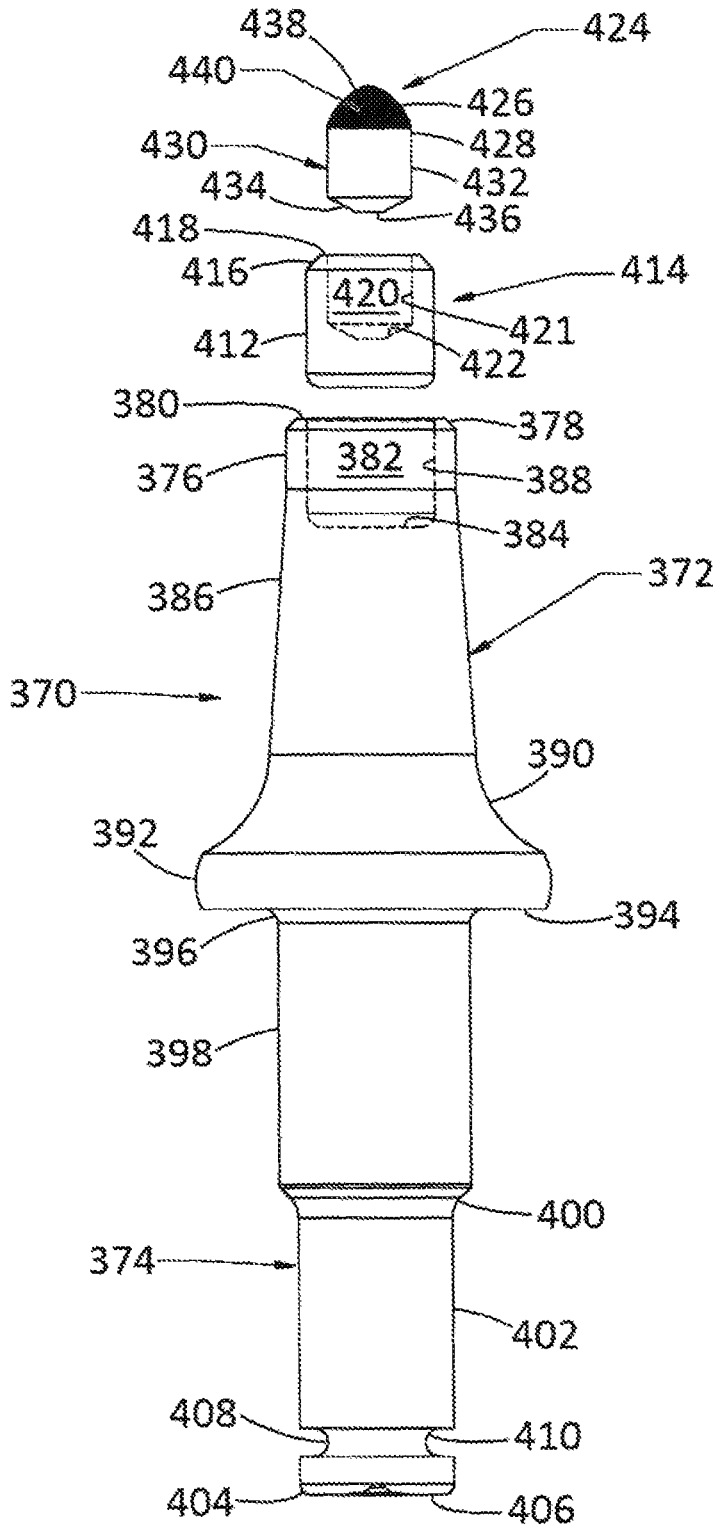
FIG. 11 is an exploded side elevation view of a sixth embodiment of a bit, showing a bit tip insert and a transition member, in accordance with implementations of this disclosure.
Figure 12:
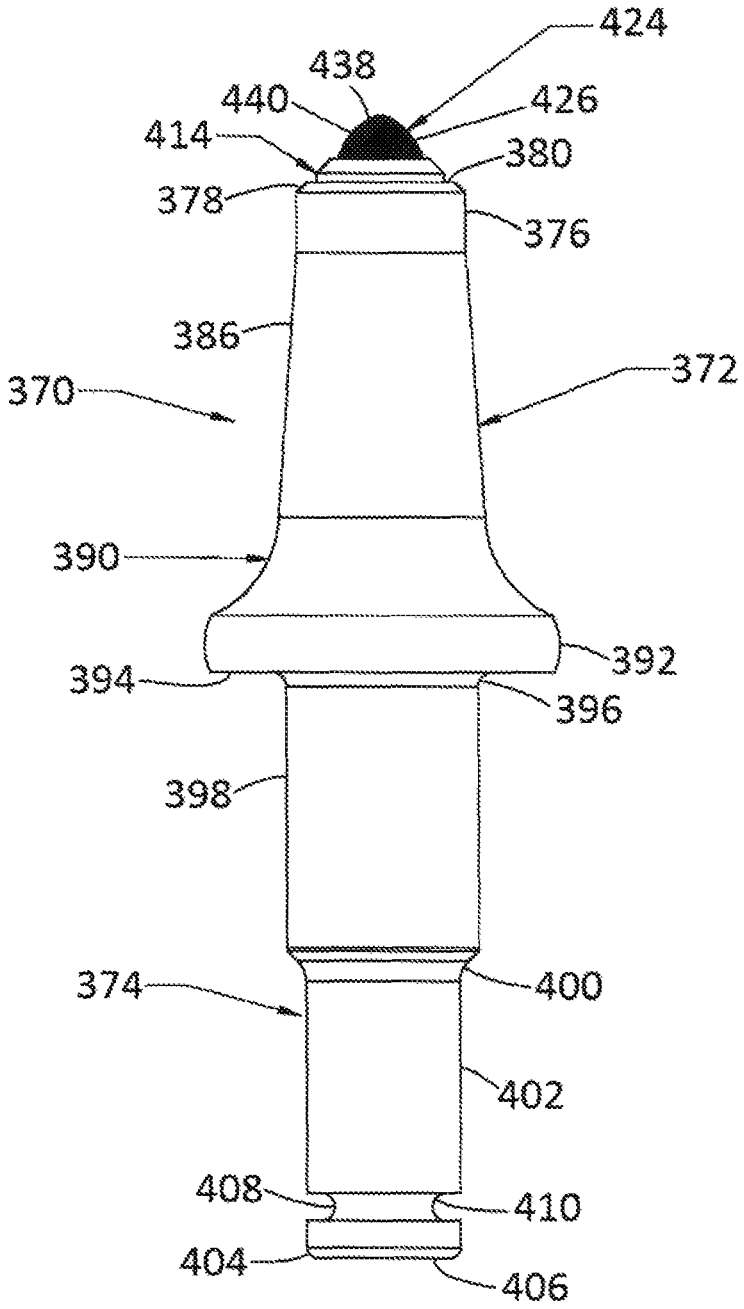
FIG. 12 is a side elevation view of the sixth embodiment of the bit, shown assembled with the bit tip insert and the transition member, in accordance with implementations of this disclosure.

Referring to FIGS. 11 and 12, a sixth embodiment of a rotatable or non-rotatable substantially solid bit or tool 370 comprises a body portion 372, which can be made of steel 15B37, 4140, 4340, or other similar suitable materials, and a shank 374 axially extending from a bottom of the body portion 372. The body portion 372 comprises a generally cylindrical first portion 376 axially depending from a frustoconical portion 378 adjacent a forward end 380 of the body portion 372. A bore 382 extends axially inwardly from the forward end 380 to a bore termination 384 disposed within a generally cylindrical or outwardly tapered second portion 386 subjacent the first portion 376. In this illustrated embodiment, the bore 382 includes a generally cylindrical sidewall 388 and the bore termination 384 is generally flat. Subjacent the second portion 386 is a third portion 390 that generally slopes axially and radially outwardly to a radially extending generally arcuate fourth portion or tire portion 392 that terminates at a generally annular back flange 394 that denotes the bottom of the body portion 372.

The shank 374 comprises a first segment 396 that slopes axially and radially inwardly from the back flange 394 to a generally cylindrical second segment 398. The second segment 398 axially extends from the first segment 396 to a shoulder 400 that slopes axially and radially inwardly from the second segment 398 to a generally cylindrical third segment 402. The third segment 402 axially extends from the shoulder 400 to a distal portion 404 adjacent a distal end 406 of the shank 374. The third segment 402 comprises an annular groove 408, which in this illustrated embodiment has an arcuate inner surface 410 but can also have a flat surface in other embodiments, adjacent the distal portion 404 of the shank 374 where it can be engaged by a bit retainer or the like.

The generally cylindrical bore 382 provides a space for receiving a complementary shaped generally cylindrical outer surface or body 412 of an insert or transition member 414, which in this embodiment is made of tungsten carbide. The transition member 414 comprises a frustoconical portion 416 subjacent a forward end 418 of the transition member 414 that axially extends to the body 412. The transition member 414 further comprises a bore 420, which includes a generally cylindrical sidewall 421 in this embodiment, that extends axially inwardly from the forward end 418 of the transition member 414 to a bore termination 422 disposed within the body 412 of the transition member 414. In this illustrated embodiment, the bore termination 422 has a frustoconical shape. The transition member 414 for the bit 370 extends axially upwardly longitudinally from the forward end 380 of the body portion 372 when the body 412 is placed in the complementary shaped bore 382 of the body portion 372.

A bit tip insert 424 comprises a generally conical tip 426 at a forward end 428 of a base 430 that includes a parabolic curved section below an apex of the tip insert 424. The tip 426 can also have a frustoconical shape, a flat generally cylindrical puck shape, a parabolic ballistic shape, an angular shape, and/or an arcuate shape. In one exemplary implementation of the sixth embodiment, the tip insert 424 can have a diameter in the range of ⅝ inch to 1.250 inch. The base 430 comprises a complementary shaped generally cylindrical outer surface or sidewall 432 that is adapted to be mounted in the complementary shaped bore 420 that provides a space for receiving the bit tip insert 424. In this sixth embodiment, the base 430 includes a frustoconical portion 434, adjacent a distal end 436 of the base 430, which is complementary shaped to the bore termination 422 of the transition member 414. The sidewall 432 of the base 430 may require grinding. The frustoconical portion 434 and the distal end 436 do not require additional finishing processes, such as grinding. The base 430 may be made of steel or tungsten carbide and includes the tip 426 at the outer or forward end 428 of the base 430.

In this embodiment, the tip 426 comprises a substrate (not shown) that is primarily made of tungsten carbide and comprises an outer surface or forward end 438 that includes an overlay 440 of a polycrystalline diamond structure. The outer surface 438 of the tip 426 may also have an overlay 440 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 426 and the forward end 428 of the base 430. The excess PCD material can be used as formed on tools that are used in milling, trenching, mining, and similar applications. The overlay 440 occupies a large radial and axial profile of the tip 426 which allows faster heat transfer into a region subjacent to the overlay 440 PCD layer. Excessively high heat, such as temperatures above 1300 degrees F., is the greatest cause of PCD failure due to diamond connective failure, the quick heat transfer from the tip 426 of the PCD cutting zone to the subjacent region below the PCD drastically reduces the possibility of a temperature of the tip 426 of the PCD reaching temperatures at or above 1300 degrees F. for any extended period of time thereby avoiding failure of the PCD layer. To assemble the bit or tool 370 into a unitary piece, the transition member 414 is brazed in bore 382 of the body portion 372 and the bit tip insert 424 is brazed in the bore 420 of the transition member 414, as shown in FIG. 12.

Figure 13:
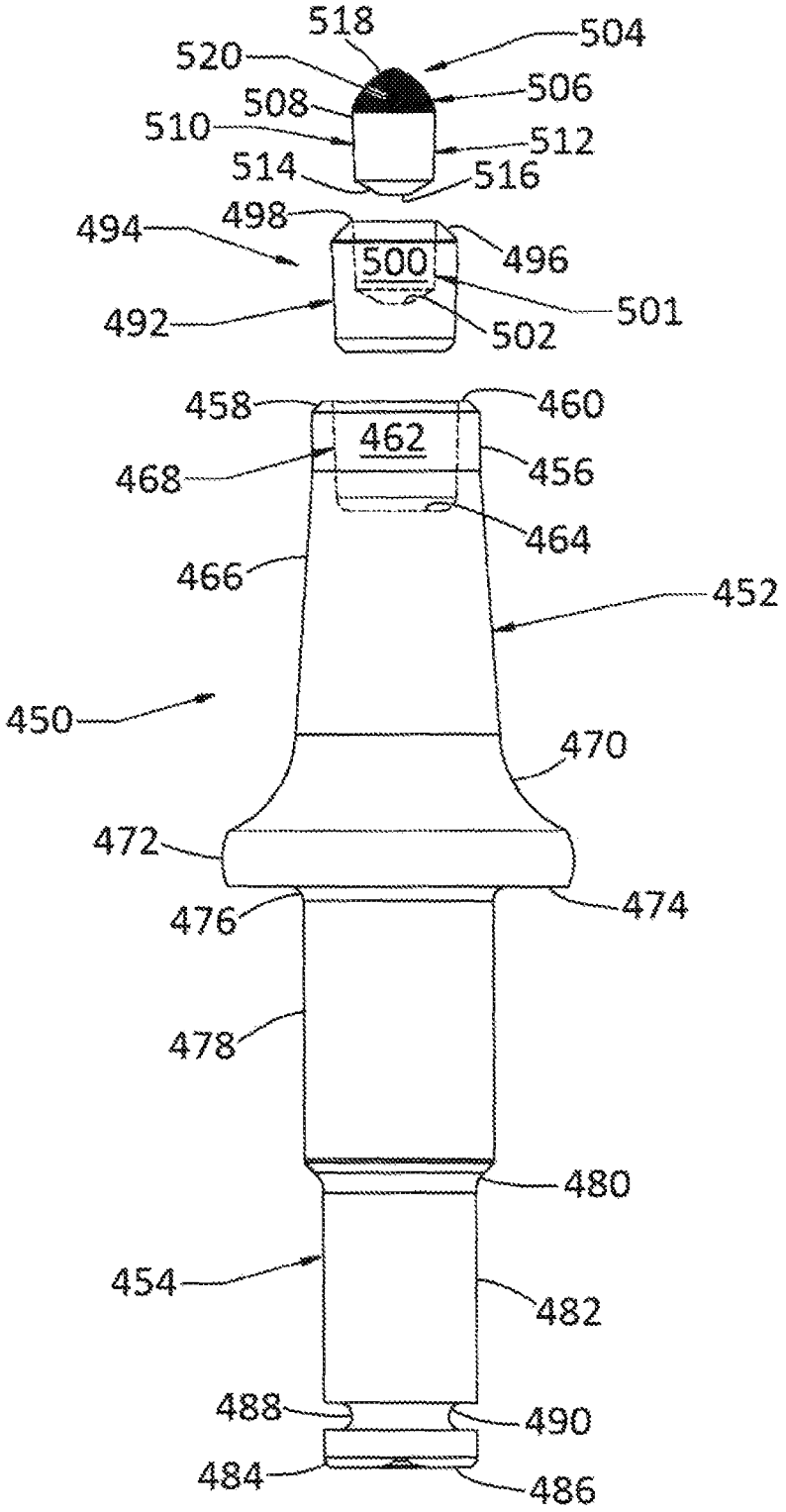
FIG. 13 is an exploded side elevation view of a seventh embodiment of a bit, showing a bit tip insert and a transition member, in accordance with implementations of this disclosure.
Figure 14:
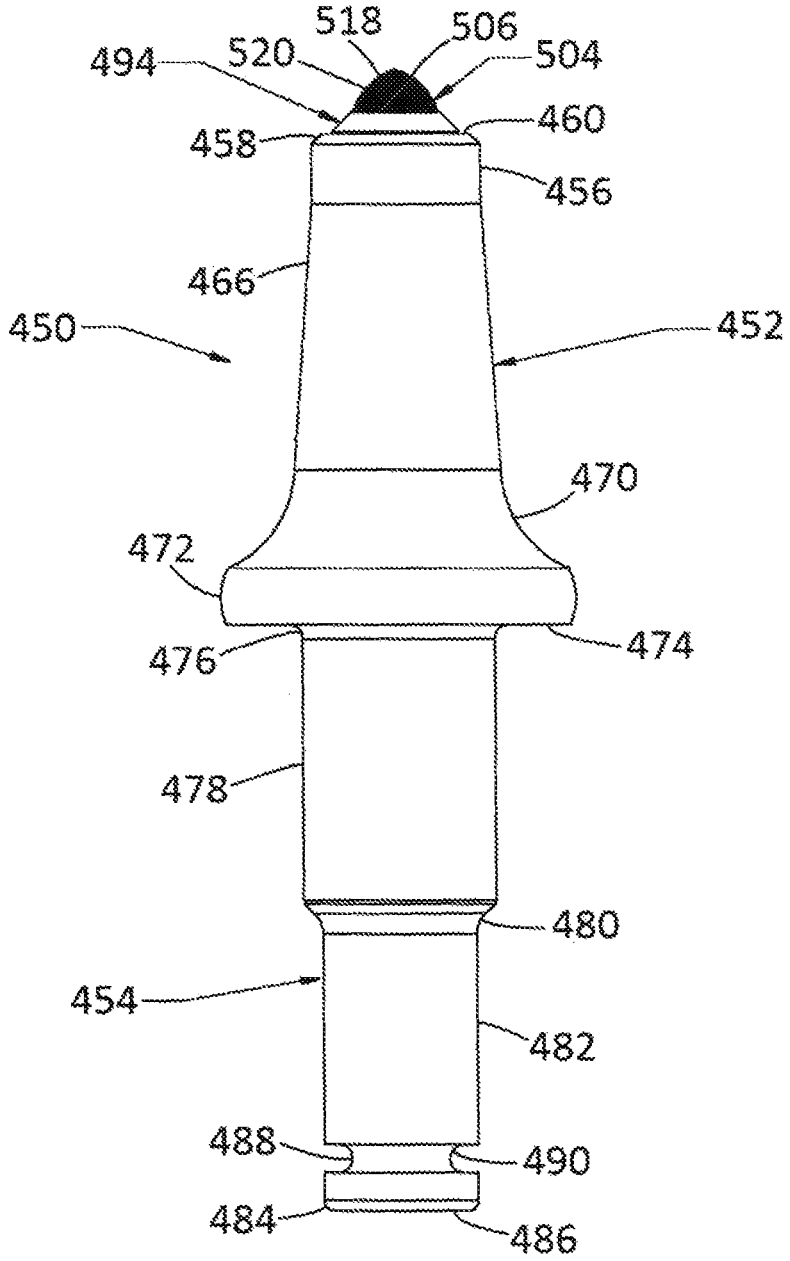
FIG. 14 is a side elevation view of the seventh embodiment of the bit, shown assembled with the bit tip insert and the transition member, in accordance with implementations of this disclosure.

Referring to FIGS. 13 and 14, a seventh embodiment of a rotatable or non-rotatable substantially solid bit or tool 450 comprises a body portion 452, which can be made of steel 15B37, 4140, 4340, or other similar suitable materials, and a shank 454 axially extending from a bottom of the body portion 452. The body portion 452 comprises a generally cylindrical first portion 456 axially depending from a frustoconical portion 458 adjacent a forward end 460 of the body portion 452. A bore 462 extends axially inwardly from the forward end 460 to a bore termination 464 disposed within a generally cylindrical or outwardly tapered second portion 466 subjacent the first portion 456. In this illustrated embodiment, the bore 462 includes a tapered sidewall 468 and the bore termination 464 is generally flat. Subjacent the second portion 466 is a third portion 470 that generally slopes axially and radially outwardly to a radially extending generally arcuate fourth portion or tire portion 472 that terminates at a generally annular back flange 474 that denotes the bottom of the body portion 452.

The shank 454 comprises a first segment 476 that slopes axially and radially inwardly from the back flange 474 to a generally cylindrical second segment 478. The second segment 478 axially extends from the first segment 476 to a shoulder 480 that slopes axially and radially inwardly from the second segment 478 to a generally cylindrical third segment 482. The third segment 482 axially extends from the shoulder 480 to a distal portion 484 adjacent a distal end 486 of the shank 454. The third segment 482 comprises an annular groove 488, which in this illustrated embodiment has an arcuate inner surface 490 but can also have a flat surface in other embodiments, adjacent the distal portion 484 of the shank 454 where it can be engaged by a bit retainer or the like.

The tapered bore 462 provides a space for receiving a complementary shaped tapered outer surface or body 492 of an insert or transition member 494, which in this embodiment is made of tungsten carbide. The transition member 494 comprises a frustoconical portion 496 subjacent a forward end 498 of the transition member 494 that axially extends to the body 492. The transition member 494 further comprises a bore 500, which includes a tapered sidewall 501 in this embodiment, that extends axially inwardly from the forward end 498 of the transition member 494 to a bore termination 502 disposed within the body 492 of the transition member 494. In this illustrated embodiment, the bore termination 502 has a frustoconical shape. The transition member 494 for the bit 450 extends axially upwardly longitudinally from the forward end 460 of the body portion 452 when the body 492 is placed in the complementary shaped bore 462 of the body portion 452.

A bit tip insert 504 comprises a generally conical tip 506 at a forward end 508 of a base 510 that includes a parabolic curved section below an apex of the tip insert 504. The tip 506 can also have a frustoconical shape, a flat generally cylindrical puck shape, a parabolic ballistic shape, an angular shape, and/or an arcuate shape. In one exemplary implementation of the seventh embodiment, the tip insert 504 can have a diameter in the range of ⅝ inch to 1.250 inch. The base 510 comprises a complementary shaped tapered outer surface or sidewall 512 that is adapted to be mounted in the complementary shaped bore 500 that provides a space for receiving the bit tip insert 504. In this seventh embodiment, the base 510 includes a frustoconical portion 514, adjacent a distal end 516 of the base 510, which is complementary shaped to the bore termination 502 of the transition member 494. The sidewall 512 of the base 510 may require grinding. The frustoconical portion 514 and the distal end 516 do not require additional finishing processes, such as grinding. The base 510 may be made of steel or tungsten carbide and includes the tip 506 at the outer or forward end 508 of the base 510.

In this embodiment, the tip 506 comprises a substrate (not shown) that is primarily made of tungsten carbide and comprises an outer surface or forward end 518 that includes an overlay 520 of a polycrystalline diamond structure. The outer surface 518 of the tip 506 may also have an overlay 520 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 506 and the forward end 508 of the base 510. The excess PCD material can be used as formed on tools that are used in milling, trenching, mining, and similar applications. The overlay 520 occupies a large radial and axial profile of the tip 506 which allows faster heat transfer into a region subjacent to the overlay 520 PCD layer. Excessively high heat, such as temperatures above 1300 degrees F., is the greatest cause of PCD failure due to diamond connective failure, the quick heat transfer from the tip 506 of the PCD cutting zone to the subjacent region below the PCD drastically reduces the possibility of a temperature of the tip 506 of the PCD reaching temperatures at or above 1300 degrees F. for any extended period of time thereby avoiding failure of the PCD layer. To assemble the bit or tool 450 into a unitary piece, the transition member 494 is brazed in bore 462 of the body portion 452 and the bit tip insert 504 is brazed in the bore 500 of the transition member 494, as shown in FIG. 14.

Figure 15:
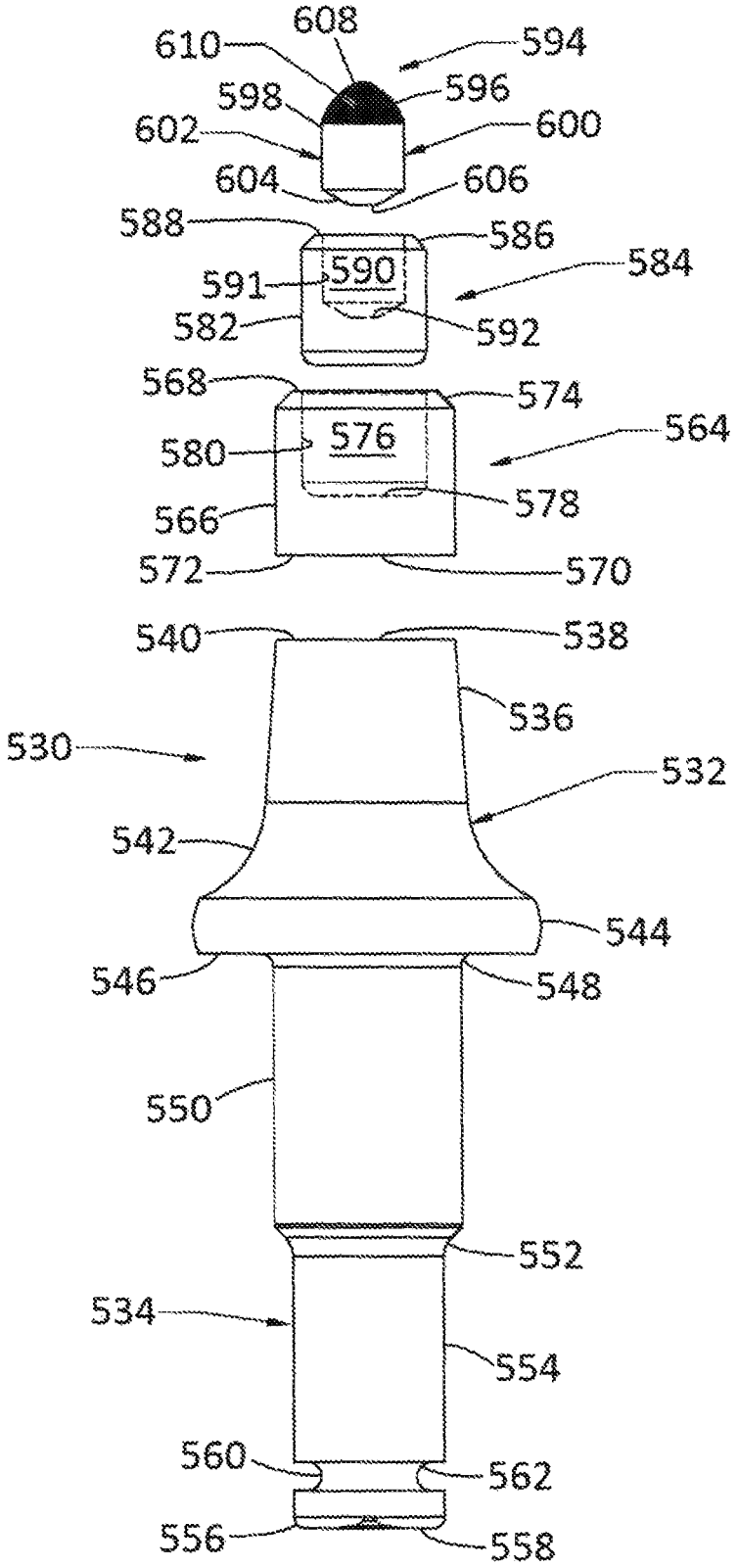
FIG. 15 is an exploded side elevation view of an eighth embodiment of a bit, showing a forward portion of the bit prior to welding, a bit tip insert, and a transition member, in accordance with implementations of this disclosure.
Figure 16:
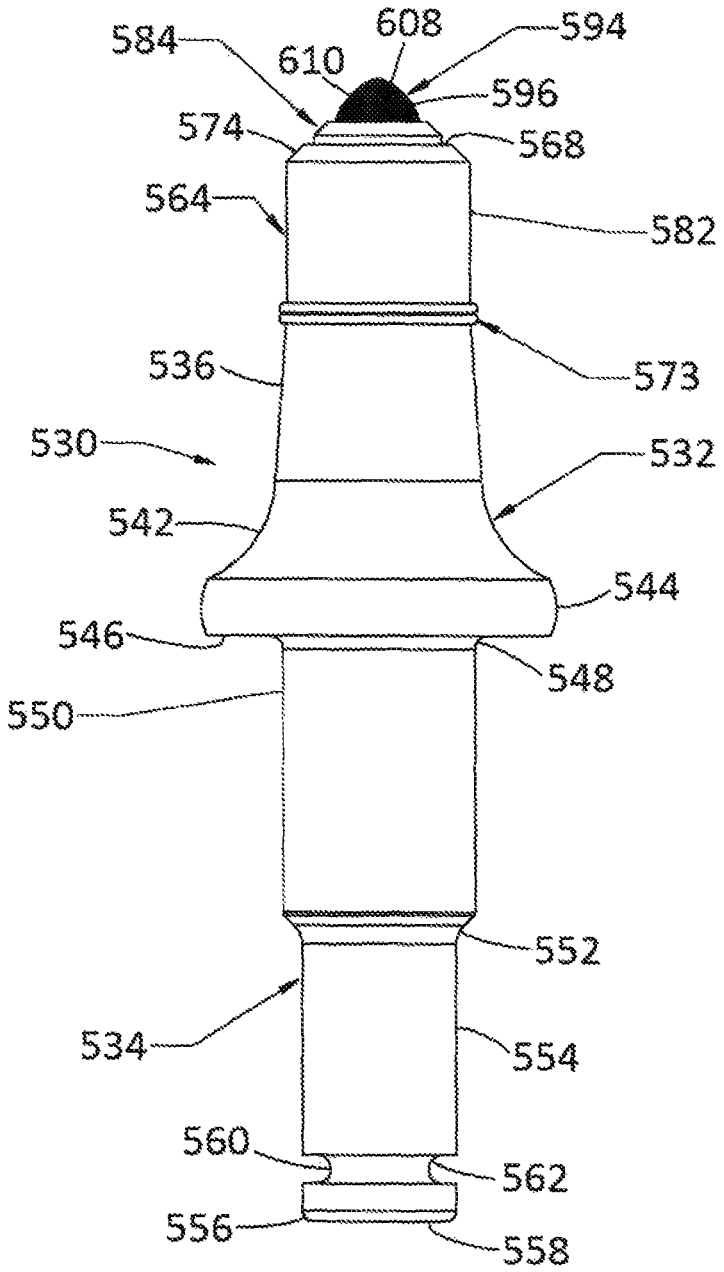
FIG. 16 is a side elevation view of the eighth embodiment of the bit, shown after welding the forward portion to the bit and assembled with the bit tip insert and the transition member, in accordance with implementations of this disclosure.

Referring to FIGS. 15 and 16, an eighth embodiment of a rotatable or non-rotatable substantially solid bit or tool 530 comprises a body portion 532, which can be made of steel 15B37, 4140, 4340, or other similar suitable materials, and a shank 534 axially extending from a bottom of the body portion 532. The body portion 532 comprises a generally cylindrical or outwardly tapered upper body portion 536 axially depending from an interface 538, such as a flat annular or generally cylindrical surface in this exemplary embodiment, that defines a forward end 540 of the body portion 532. Subjacent the upper body portion 536 is a mediate body portion 542 that generally slopes axially and radially outwardly to a radially extending generally arcuate tire portion 544 that terminates at a generally annular back flange 546 that denotes the bottom of the body portion 532.

The shank 534 comprises a first segment 548 that slopes axially and radially inwardly from the back flange 546 to a generally cylindrical second segment 550. The second segment 550 axially extends from the first segment 548 to a shoulder 552 that slopes axially and radially inwardly from the second segment 550 to a generally cylindrical third segment 554. The third segment 554 axially extends from the shoulder 552 to a distal portion 556 adjacent a distal end 558 of the shank 534. The third segment 554 comprises an annular groove 560, which in this illustrated embodiment has an arcuate inner surface 562 but can also have a flat surface in other embodiments, adjacent the distal portion 556 of the shank 534 where it can be engaged by a bit retainer or the like.

A forward body or nose portion 564, which can be made of steel 15B47, 4140, 4340, or other similar suitable materials and/or high wear, abrasive resistant, high strength alloy steel with a KSI strength in excess of 200 KSI, comprises a body 566 that axially extends from a forward end 568 to an interface 570, such as a flat annular or generally cylindrical surface in this exemplary embodiment, defining a distal end 572 of the forward body portion 564. The interface 570 of the forward body portion 564 is friction welded to the interface 538 of the body portion 532 of the bit 530, which forms a friction welded joint 573 (FIG. 16) between the forward body portion 564 and the body portion 532. The forward body portion 564 further includes a frustoconical portion 574 adjacent the forward end 568 and a bore 576 that extends axially inwardly from the forward end 568 to a bore termination 578 disposed within the forward body portion 564. In this illustrated embodiment, the bore 576 includes a generally cylindrical sidewall 580 and the bore termination 578 is generally flat.

The generally cylindrical bore 576 provides a space for receiving a complementary shaped generally cylindrical outer surface or body 582 of an insert or transition member 584, which in this embodiment is made of tungsten carbide. The transition member 584 comprises a frustoconical portion 586 subjacent a forward end 588 of the transition member 584 that axially extends to the body 582. The transition member 584 further comprises a bore 590, which includes a generally cylindrical sidewall 591 in this embodiment, that extends axially inwardly from the forward end 588 of the transition member 584 to a bore termination 592 disposed within the body 582 of the transition member 584. In this illustrated embodiment, the bore termination 592 has a frustoconical shape. The transition member 584 for the bit 530 extends axially upwardly longitudinally from the forward end 568 of the forward body portion 564 when the body 582 is placed in the complementary shaped bore 576 of the forward body portion 564.

A bit tip insert 594 comprises a generally conical tip 596 at a forward end 598 of a base 600 that includes a parabolic curved section below an apex of the tip insert 594. The tip 596 can also have a frustoconical shape, a flat generally cylindrical puck shape, a parabolic ballistic shape, an angular shape, and/or an arcuate shape. In one exemplary implementation of the eighth embodiment, the tip insert 594 can have a diameter in the range of ⅝ inch to 1.250 inch. The base 600 comprises a complementary shaped generally cylindrical outer surface or sidewall 602 that is adapted to be mounted in the complementary shaped bore 590 that provides a space for receiving the bit tip insert 594. In this eighth embodiment, the base 600 includes a frustoconical portion 604, adjacent a distal end 606 of the base 600, which is complementary shaped to the bore termination 592 of the transition member 584. The sidewall 602 of the base 600 may require grinding. The frustoconical portion 604 and the distal end 606 do not require additional finishing processes, such as grinding. The base 600 may be made of steel or tungsten carbide and includes the tip 596 at the outer or forward end 598 of the base 600.

In this embodiment, the tip 596 comprises a substrate (not shown) that is primarily made of tungsten carbide and comprises an outer surface or forward end 608 that includes an overlay 610 of a polycrystalline diamond structure. The outer surface 608 of the tip 596 may also have an overlay 610 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 596 and the forward end 598 of the base 600. The excess PCD material can be used as formed on tools that are used in milling, trenching, mining, and similar applications. The overlay 610 occupies a large radial and axial profile of the tip 596 which allows faster heat transfer into a region subjacent to the overlay 610 PCD layer. Excessively high heat, such as temperatures above 1300 degrees F., is the greatest cause of PCD failure due to diamond connective failure, the quick heat transfer from the tip 596 of the PCD cutting zone to the subjacent region below the PCD drastically reduces the possibility of a temperature of the tip 596 of the PCD reaching temperatures at or above 1300 degrees F. for any extended period of time thereby avoiding failure of the PCD layer. To assemble the bit or tool 530 into a unitary piece, the interface 570 of the forward body portion 564 is friction welded to the interface 538 of the body portion 532 of the bit 530. Then, the transition member 584 is brazed in bore 576 of the forward body portion 564 and the bit tip insert 594 is brazed in the bore 590 of the transition member 584, as shown in FIG. 16. The bit tip insert 832 may also be brazed to transition member 584 and the transition member 584 may also be brazed to the forward body portion 564 and then hardened prior friction welding.

Figure 17:
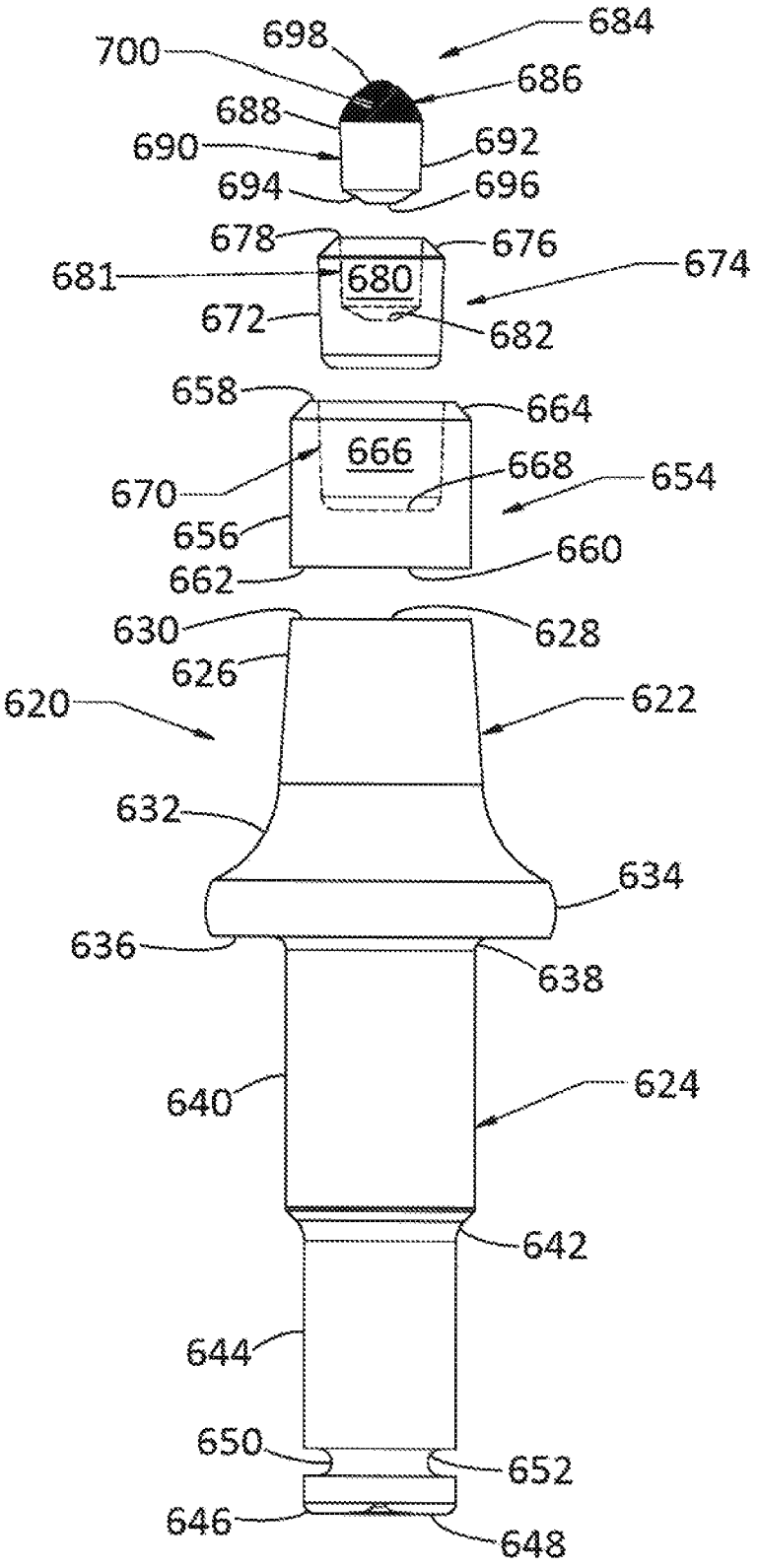
FIG. 17 is an exploded side elevation view of a ninth embodiment of a bit, showing a forward portion of the bit prior to welding, a bit tip insert, and a transition member, in accordance with implementations of this disclosure.
Figure 18:
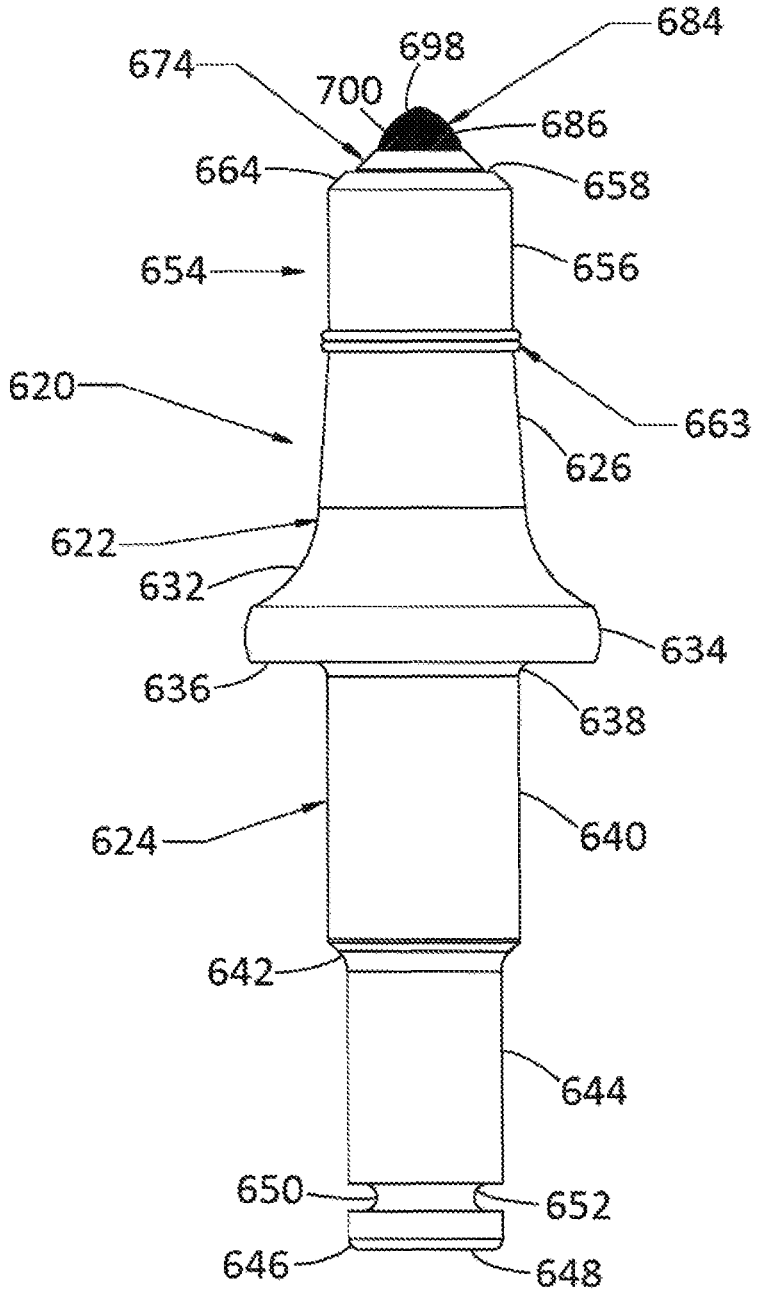
FIG. 18 is a side elevation view of the ninth embodiment of the bit, shown after welding the forward portion to the bit and assembled with the bit tip insert and the transition member, in accordance with implementations of this disclosure.

Referring to FIGS. 17 and 18, a ninth embodiment of a rotatable or non-rotatable substantially solid bit or tool 620 comprises a body portion 622, which can be made of steel 15B37, 4140, 4340, or other similar suitable materials, and a shank 624 axially extending from a bottom of the body portion 622. The body portion 622 comprises a generally cylindrical or outwardly tapered upper body portion 626 axially depending from an interface 628, such as a flat annular or generally cylindrical surface in this exemplary embodiment, that defines a forward end 630 of the body portion 622. Subjacent the upper body portion 626 is a mediate body portion 632 that generally slopes axially and radially outwardly to a radially extending generally arcuate tire portion 634 that terminates at a generally annular back flange 636 that denotes the bottom of the body portion 622.

The shank 624 comprises a first segment 638 that slopes axially and radially inwardly from the back flange 636 to a generally cylindrical second segment 640. The second segment 640 axially extends from the first segment 638 to a shoulder 642 that slopes axially and radially inwardly from the second segment 640 to a generally cylindrical third segment 644. The third segment 644 axially extends from the shoulder 642 to a distal portion 646 adjacent a distal end 648 of the shank 624. The third segment 644 comprises an annular groove 650, which in this illustrated embodiment has an arcuate inner surface 652 but can also have a flat surface in other embodiments, adjacent the distal portion 646 of the shank 624 where it can be engaged by a bit retainer or the like.

A forward body or nose portion 654, which can be made of steel 15B47, 4140, 4340, or other similar suitable materials and/or high wear, abrasive resistant, high strength alloy steel with a KSI strength in excess of 200 KSI, comprises a body 656 that axially extends from a forward end 658 to an interface 660, such as a flat annular or generally cylindrical surface in this exemplary embodiment, defining a distal end 662 of the forward body portion 654. The interface 660 of the forward body portion 654 is friction welded to the interface 628 of the body portion 622 of the bit 620, which forms a friction welded joint 663 (FIG. 18) between the forward body portion 654 and the body portion 622. The forward body portion 654 further includes a frustoconical portion 664 adjacent the forward end 658 and a bore 666 that extends axially inwardly from the forward end 658 to a bore termination 668 disposed within the forward body portion 654. In this illustrated embodiment, the bore 666 includes a tapered sidewall 670 and the bore termination 668 is generally flat.

The generally cylindrical bore 666 provides a space for receiving a complementary shaped generally cylindrical outer surface or body 672 of an insert or transition member 674, which in this embodiment is made of tungsten carbide. The transition member 674 comprises a frustoconical portion 676 subjacent a forward end 678 of the transition member 674 that axially extends to the body 672. The transition member 674 further comprises a bore 680, which includes a tapered sidewall 681 in this embodiment, that extends axially inwardly from the forward end 678 of the transition member 674 to a bore termination 682 disposed within the body 672 of the transition member 674. In this illustrated embodiment, the bore termination 682 has a frustoconical shape. The transition member 674 for the bit 620 extends axially upwardly longitudinally from the forward end 658 of the forward body portion 654 when the body 672 is placed in the complementary shaped bore 666 of the forward body portion 654.

A bit tip insert 684 comprises a generally conical tip 686 at a forward end 688 of a base 690 that includes a parabolic curved section below an apex of the tip insert 684. The tip 686 can also have a frustoconical shape, a flat generally cylindrical puck shape, a parabolic ballistic shape, an angular shape, and/or an arcuate shape. In one exemplary implementation of the ninth embodiment, the tip insert 684 can have a diameter in the range of ⅝ inch to 1.250 inch. The base 690 comprises a complementary shaped tapered outer surface or sidewall 692 that is adapted to be mounted in the complementary shaped bore 680 that provides a space for receiving the bit tip insert 684. In this ninth embodiment, the base 690 includes a frustoconical portion 694, adjacent a distal end 696 of the base 690, which is complementary shaped to the bore termination 682 of the transition member 674. The sidewall 692 of the base 690 may require grinding. The frustoconical portion 694 and the distal end 696 do not require additional finishing processes, such as grinding. The base 690 may be made of steel or tungsten carbide and includes the tip 686 at the outer or forward end 688 of the base 690.

In this embodiment, the tip 686 comprises a substrate (not shown) that is primarily made of tungsten carbide and comprises an outer surface or forward end 698 that includes an overlay 700 of a polycrystalline diamond structure. The outer surface 698 of the tip 686 may also have an overlay 700 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 686 and the forward end 688 of the base 690. The excess PCD material can be used as formed on tools that are used in milling, trenching, mining, and similar applications. The overlay 700 occupies a large radial and axial profile of the tip 686 which allows faster heat transfer into a region subjacent to the overlay 700 PCD layer. Excessively high heat, such as temperatures above 1300 degrees F., is the greatest cause of PCD failure due to diamond connective failure, the quick heat transfer from the tip 686 of the PCD cutting zone to the subjacent region below the PCD drastically reduces the possibility of a temperature of the tip 686 of the PCD reaching temperatures at or above 1300 degrees F. for any extended period of time thereby avoiding failure of the PCD layer. To assemble the bit or tool 620 into a unitary piece, the interface 660 of the forward body portion 654 is friction welded to the interface 628 of the body portion 622 of the bit 620. Then, the transition member 674 is brazed in bore 666 of the forward body portion 654 and the bit tip insert 684 is brazed in the bore 680 of the transition member 674, as shown in FIG. 18. The bit tip insert 684 may also be brazed to the transition member 674 and the transition member 674 may also be brazed to the forward body portion 654 and then hardened prior friction welding.

Figure 19:
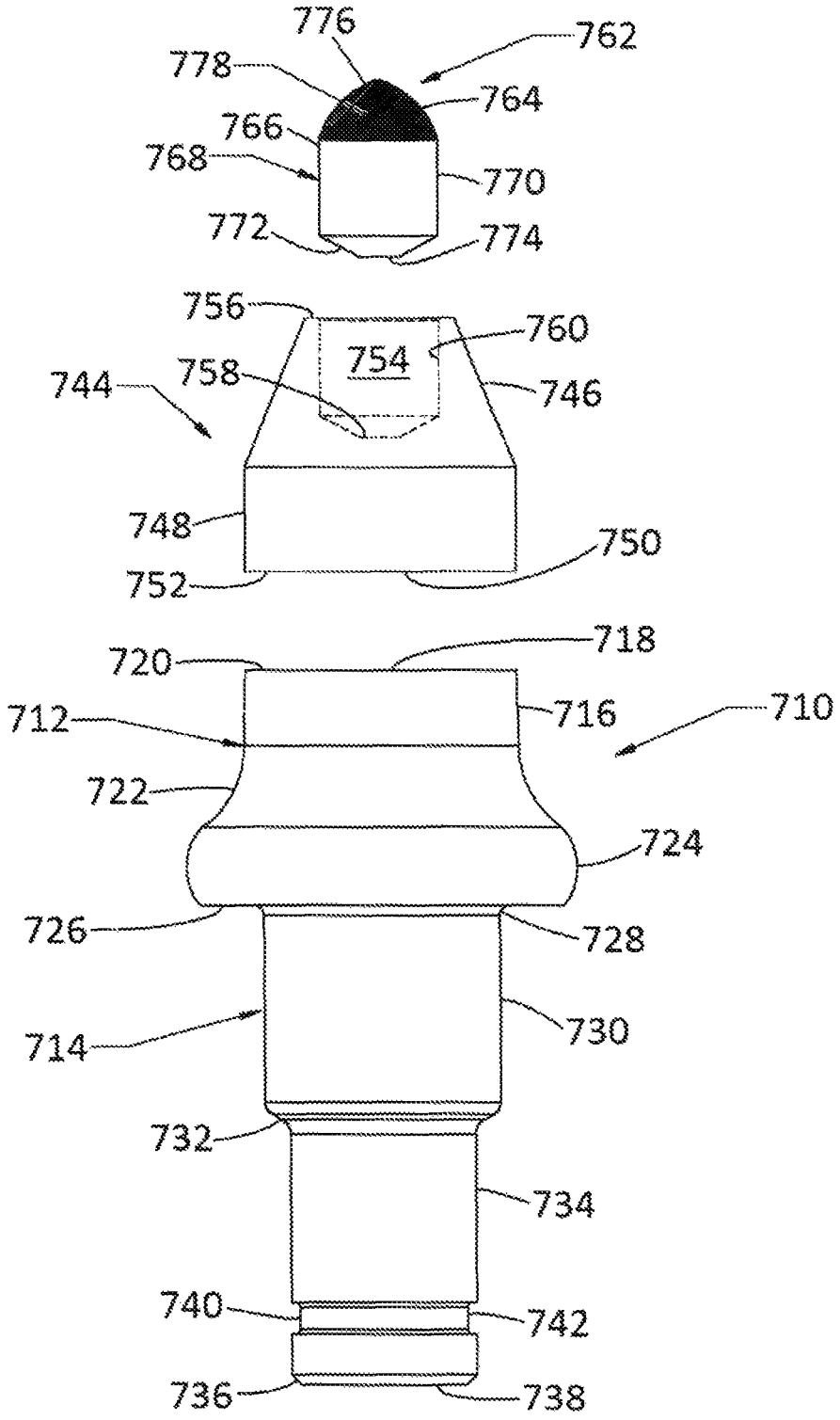
FIG. 19 is an exploded side elevation view of a tenth embodiment of a bit, showing a forward portion of the bit prior to welding and a bit tip insert, in accordance with implementations of this disclosure.
Figure 20:
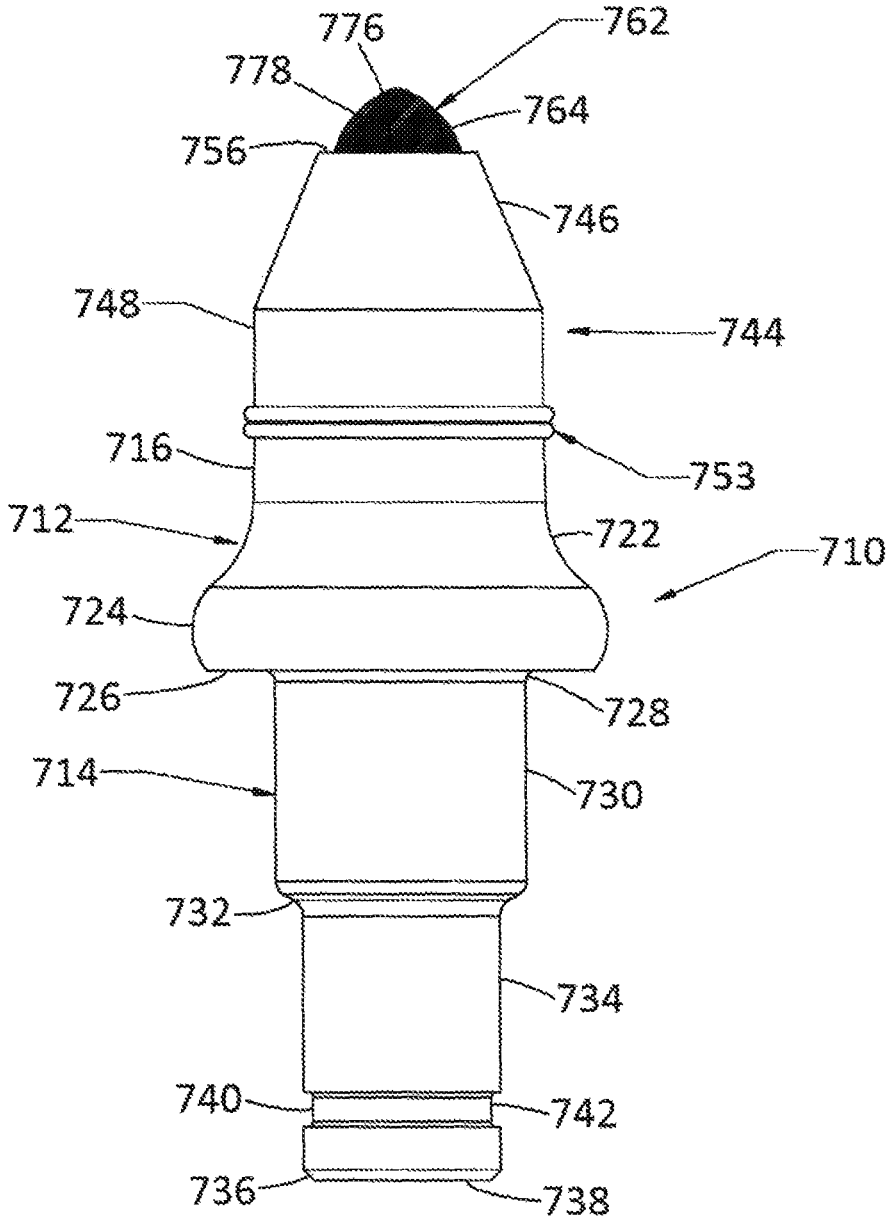
FIG. 20 is a side elevation view of the tenth embodiment of the bit, shown after welding the forward portion to the bit and assembled with the bit tip insert, in accordance with implementations of this disclosure.

Referring to FIGS. 19 and 20, a tenth embodiment of a rotatable or non-rotatable substantially solid bit or tool 710 comprises a body portion 712, which can be made of steel 15B37, 4140, 4340, or other similar suitable materials, and a shank 714 axially extending from a bottom of the body portion 712. The body portion 712 comprises a generally cylindrical upper body portion 716 axially depending from an interface 718, such as a flat annular or generally cylindrical surface in this exemplary embodiment, that defines a forward end 720 of the body portion 712. Subjacent the upper body portion 716 is a mediate body portion 722 that generally slopes axially and radially outwardly to a radially extending generally arcuate tire portion 724 that terminates at a generally annular back flange 726 that denotes the bottom of the body portion 712.

The shank 714 comprises a first segment 728 that slopes axially and radially inwardly from the back flange 726 to a generally cylindrical second segment 730. The second segment 730 axially extends from the first segment 728 to a shoulder 732 that slopes axially and radially inwardly from the second segment 730 to a generally cylindrical third segment 734. The third segment 734 axially extends from the shoulder 732 to a tapered distal portion 736 adjacent a distal end 738 of the shank 714. The third segment 734 comprises an annular groove 740, which in this illustrated embodiment has an flat inner surface 742 but can also have an arcuate surface in other embodiments, adjacent the tapered distal portion 736 of the shank 714 where it can be engaged by a bit retainer or the like.

A forward body or nose portion 744, which can be made of steel 15B47, 4140, 4340, or other similar suitable materials and/or high wear, abrasive resistant, high strength alloy steel with a KSI strength in excess of 200 KSI, comprises a frustoconical portion 746 adjacent a generally cylindrical base 748 that axially extends from the frustoconical portion 746 to an interface 750, such as a flat annular or generally cylindrical surface in this exemplary embodiment, defining a distal end 752 of the forward body portion 744. The interface 750 of the forward body portion 744 is friction welded to the interface 718 of the body portion 712 of the bit 710, which forms a friction welded joint 753 (FIG. 20) between the forward body portion 744 and the body portion 712. The frustoconical portion 746 includes a bore 754 that extends axially inwardly from a forward end 756 of the forward body portion 744 to a bore termination 758 disposed within the frustoconical portion 746. In this illustrated embodiment, the bore 754 includes a generally cylindrical sidewall 760 and the bore termination 758 has a frustoconical shape.

A bit tip insert 762 comprises a generally conical tip 764 at a forward end 766 of a base 768 that includes a parabolic curved section below an apex of the tip insert 762. The tip 764 can also have a frustoconical shape, a flat generally cylindrical puck shape, a parabolic ballistic shape, an angular shape, and/or an arcuate shape. In one exemplary implementation of the tenth embodiment, the tip insert 762 can have a diameter in the range of ⅝ inch to 1.250 inch. The base 768 comprises a complementary shaped generally cylindrical outer surface or sidewall 770 that is adapted to be mounted in the complementary shaped bore 754 that provides a space for receiving the bit tip insert 762. In this tenth embodiment, the base 768 includes a frustoconical portion 772, adjacent a distal end 774 of the base 768, which is complementary shaped to the bore termination 758 of the forward body portion 744. The sidewall 770 of the base 768 may require grinding. The frustoconical portion 772 and the distal end 774 do not require additional finishing processes, such as grinding. The base 768 may be made of steel or tungsten carbide and includes the tip 764 at the outer or forward end 766 of the base 768.

In this embodiment, the tip 764 comprises a substrate (not shown) that is primarily made of tungsten carbide and comprises an outer surface or forward end 776 that includes an overlay 778 of a polycrystalline diamond structure. The outer surface 776 of the tip 764 may also have an overlay 778 of an industrial diamond material and may include a single coating or outer layer or multiple coating or outer layers of such industrial diamond material, natural diamond, polycrystalline diamond (PCD) material, and polycrystalline diamond composite or compact (PDC) material. The single or multiple coatings or layers may be formed by a high pressure, high temperature (HPHT) process. During the HPHT process, excess PCD material may form a bulge or small flash between the tip 764 and the forward end 766 of the base 768. The excess PCD material can be used as formed on tools that are used in milling, trenching, mining, and similar applications. The overlay 778 occupies a large radial and axial profile of the tip 764 which allows faster heat transfer into a region subjacent to the overlay 778 PCD layer. Excessively high heat, such as temperatures above 1300 degrees F., is the greatest cause of PCD failure due to diamond connective failure, the quick heat transfer from the tip 764 of the PCD cutting zone to the subjacent region below the PCD drastically reduces the possibility of a temperature of the tip 764 of the PCD reaching temperatures at or above 1300 degrees F. for any extended period of time thereby avoiding failure of the PCD layer. To assemble the bit or tool 710 into a unitary piece, the interface 750 of the forward body portion 744 is friction welded to the interface 718 of the body portion 712 of the bit 710. Then, the bit tip insert 762 is brazed in the bore 754 of the forward body portion 744, as shown in FIG. 20. The bit tip insert 762 may also be brazed to the forward body portion 744 and then hardened prior friction welding.

Figure 21:
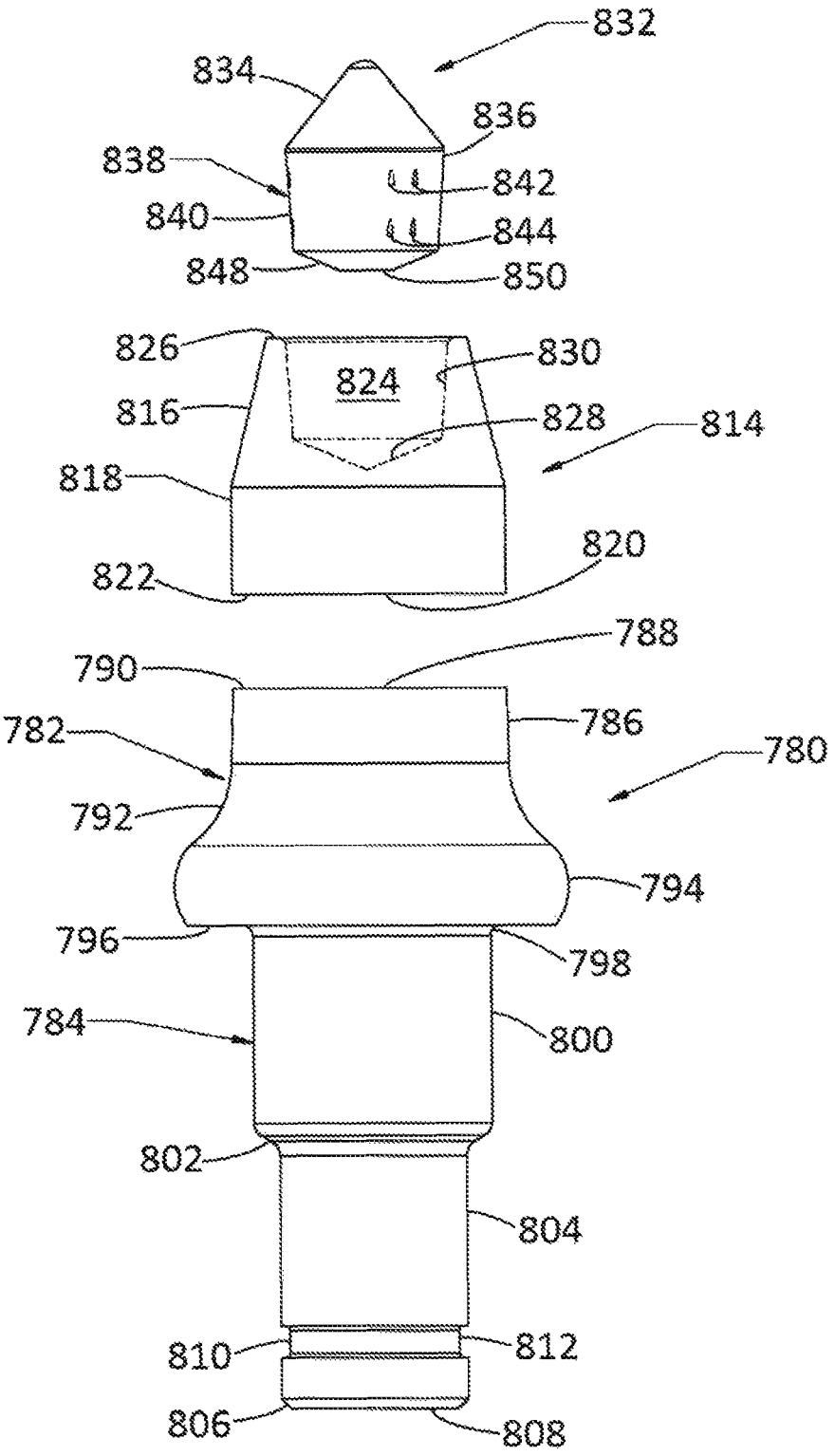
FIG. 21 is an exploded side elevation view of an eleventh embodiment of a bit, showing a forward portion of the bit prior to welding and a bit tip insert, in accordance with implementations of this disclosure.
Figure 22:
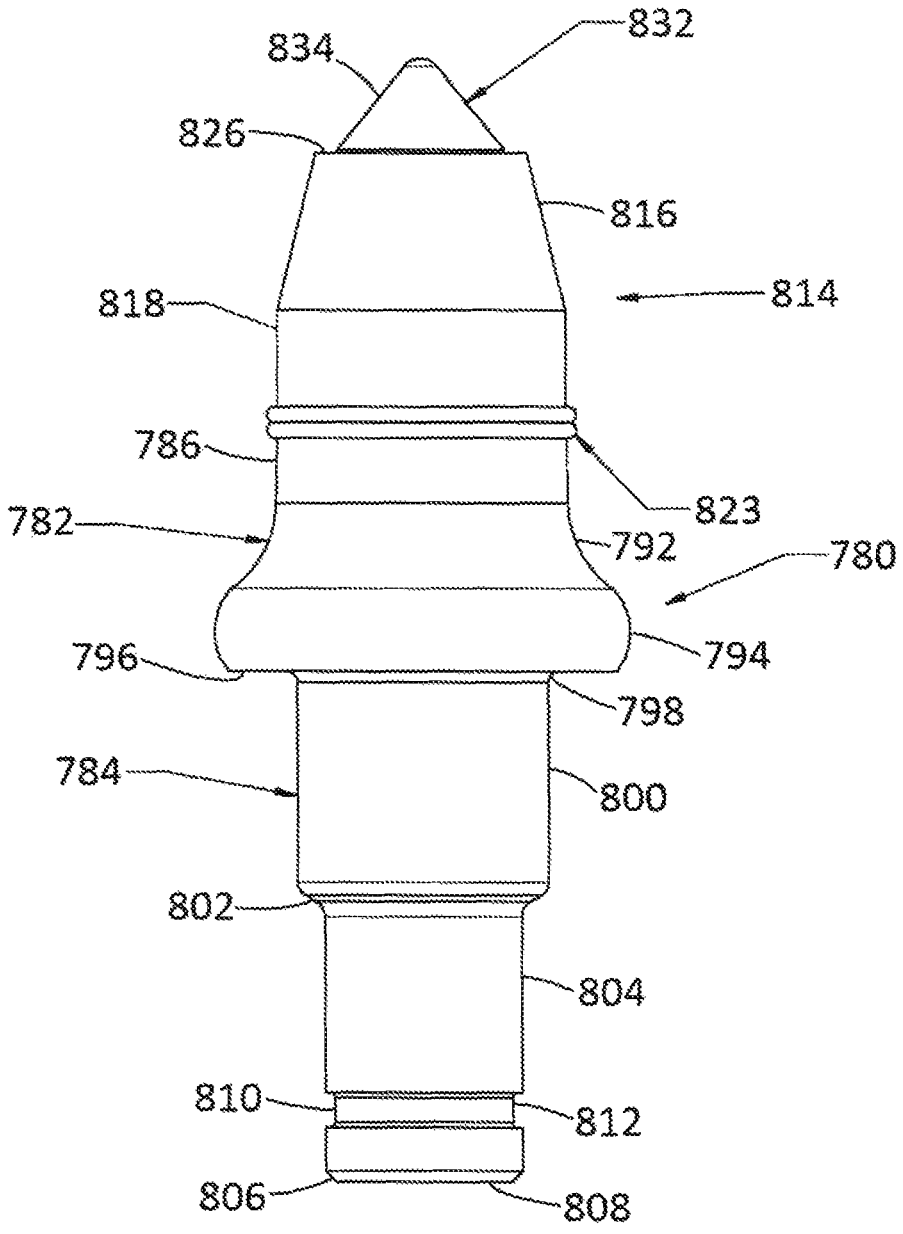
FIG. 22 is a side elevation view of the eleventh embodiment of the bit, shown after welding the forward portion to the bit and assembled with the bit tip insert, in accordance with implementations of this disclosure.

Referring to FIGS. 21 and 22, an eleventh embodiment of a rotatable or non-rotatable substantially solid bit or tool 780 comprises a body portion 782, which can be made of steel 15B37, 4140, 4340, or other similar suitable materials, and a shank 784 axially extending from a bottom of the body portion 782. The body portion 782 comprises a generally cylindrical upper body portion 786 axially depending from an interface 788, such as a flat annular or generally cylindrical surface in this exemplary embodiment, that defines a forward end 790 of the body portion 782. Subjacent the upper body portion 786 is a mediate body portion 792 that generally slopes axially and radially outwardly to a radially extending generally arcuate tire portion 794 that terminates at a generally annular back flange 796 that denotes the bottom of the body portion 782.

The shank 784 comprises a first segment 798 that slopes axially and radially inwardly from the back flange 796 to a generally cylindrical second segment 800. The second segment 800 axially extends from the first segment 798 to a shoulder 802 that slopes axially and radially inwardly from the second segment 800 to a generally cylindrical third segment 804. The third segment 804 axially extends from the shoulder 802 to a tapered distal portion 806 adjacent a distal end 808 of the shank 784. The third segment 804 comprises an annular groove 810, which in this illustrated embodiment has an flat inner surface 812 but can also have an arcuate surface in other embodiments, adjacent the tapered distal portion 806 of the shank 744 where it can be engaged by a bit retainer or the like.

A forward body or nose portion 814, which can be made of steel 15B47, 4140, 4340, or other similar suitable materials and/or high wear, abrasive resistant, high strength alloy steel with a KSI strength in excess of 200 KSI, comprises a frustoconical portion 816 adjacent a generally cylindrical base 818 that axially extends from the frustoconical portion 816 to an interface 820, such as a flat annular or generally cylindrical surface in this exemplary embodiment, defining a distal end 822 of the forward body portion 814. The interface 820 of the forward body portion 814 is friction welded to the interface 788 of the body portion 782 of the bit 780, which forms a friction welded joint 823 (FIG. 22) between the forward body portion 814 and the body portion 782. The frustoconical portion 816 includes a bore 824 that extends axially inwardly from a forward end 826 of the forward body portion 814 to a bore termination 828 disposed within the frustoconical portion 816. In this illustrated embodiment, the bore 824 includes a tapered sidewall 830 and the bore termination 828 has a frustoconical shape.

A bit tip insert 832 comprises a generally conical tip 834 at a forward end 836 of a base 838 that includes an angular section below an apex of the tip insert 832. The tip 834 can also have a frustoconical shape, a flat generally cylindrical puck shape, a parabolic ballistic shape, an angular shape, and/or an arcuate shape. In one exemplary implementation of the eleventh embodiment, the tip insert 832 can have a diameter in the range of ⅝ inch to 1.250 inch. The base 838 comprises a complementary shaped tapered outer surface or sidewall 840 that is adapted to be mounted in the complementary shaped bore 824 that provides a space for receiving the bit tip insert 832. The base 838 includes a frustoconical portion 848, adjacent a distal end 850 of the bit tip insert 832, which is complementary shaped to the bore termination 828 of the forward body portion 814. In this eleventh embodiment, the sidewall 840 of the base 838 comprises a first plurality of circumferentially spaced protrusions 842 adjacent the forward end 836 of the base 838 and a second plurality of circumferentially spaced protrusions 844 adjacent the frustoconical portion 848 of the base 838, the first plurality of circumferentially spaced protrusions 842 and the second plurality of circumferentially spaced protrusions 844 adapted to provide for precision spacing between the parts, and both self-centering and self-aligning of the tip insert 832 in the bore 824 of the forward body portion 814. In this exemplary implementation of the eleventh embodiment, preferably the sidewall 840 of the base 838 is sufficiently spaced from the sidewall 830 of the bore 824 of the forward body portion 814 and the frustoconical portion 848 adjacent the distal end 850 of the bit tip insert 832 is sufficiently spaced from the bore termination 828 of the bore 824 of the forward body portion 814 to allow braze material to flow between the parts.

The sidewall 840 of the base 838 may require grinding. The frustoconical portion 848 and the distal end 850 do not require additional finishing processes, such as grinding. The base 838 may be made of steel or tungsten carbide and includes the tip 834 at the outer or forward end 836 of the base 838. In this embodiment, both the base 838 and the tip 834 are made of tungsten carbide. To assemble the bit or tool 780 into a unitary piece, the interface 820 of the forward body portion 814 is friction welded to the interface 788 of the body portion 782 of the bit 780. Then, the bit tip insert 832 is brazed in the bore 824 of the forward body portion 814, as shown in FIG. 22. The bit tip insert 832 may also be brazed to the forward body portion 814 and then hardened prior friction welding.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments, it is to be understood that the present disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A tool comprising:

a body portion and a generally cylindrical shank depending axially from a bottom of the body portion, the body portion comprising one of a generally cylindrical first bore and a tapered first bore axially extending from a forward end of the body portion to a first bore termination disposed within the body portion, the first bore termination comprising a planar bottom and a concave axially rounded edge adjacent the planar bottom; and a transition member comprising a frustoconical forward portion, a rearward portion subjacent the frustoconical forward portion, and a second bore axially extending from a forward end of the transition member through the frustoconical forward portion to a second bore termination disposed within the rearward portion, the rearward portion comprising a flat bottom and a sidewall extending from the frustoconical forward portion to a convex rounded surface between the flat bottom and the sidewall of the transition member, the sidewall of the transition member being one of a generally cylindrical sidewall and a tapered sidewall complementary shaped to the first bore of the body portion, the transition member adapted to be mounted within the first bore of the body portion.

2. The tool of claim 1, further comprising:

a bit tip insert comprising a base including one of a generally cylindrical sidewall and a tapered sidewall complementary shaped to the second bore of the transition member, the base of the bit tip insert adapted to be mounted within the second bore of the transition member.

3. The tool of claim 2, further comprising:

a frustoconical portion adjacent a distal end of the base of the bit tip insert, the frustoconical portion complementary shaped to the second bore termination.

4. The tool of claim 2, wherein the base of the bit tip insert is made of tungsten carbide.

5. The tool of claim 2, further comprising:

a tip adjacent a forward end of a sidewall of the base of the bit tip insert, the tip comprising an overlay including at least one of a polycrystalline diamond, industrial diamond, natural diamond, polycrystalline diamond composite material, and polycrystalline diamond compact material.

6. The tool of claim 5, wherein the overlay comprises at least one of:

at least one coating on an outer surface of the tip; and at least one layer on an outer surface of the tip.

7. The tool of claim 5, wherein the overlay of the tip is formed by a high pressure high temperature (HPHT) process.

8. The tool of claim 1, wherein the transition member is made of tungsten carbide.

9. The tool of claim 1, wherein the forward portion is made of steel having a tensile strength of at least 200 KSI.

10. The tool of claim 1, further comprising:

a groove adjacent a distal end of the shank, the groove comprising one of a flat inner surface and an arcuate inner surface.

11. The tool of claim 1, the second bore comprising one of a generally cylindrical sidewall and a tapered sidewall.

12. A tool comprising:

a body portion and a generally cylindrical shank depending axially from the body portion;

a forward portion integrally attached to the body portion, the forward portion comprising a first frustoconical forward portion, a first rearward portion adjacent the first frustoconical forward portion, and one of a generally cylindrical first bore and a tapered first bore axially extending from a forward end of the forward portion to a first bore termination disposed within the first rearward portion, the first bore termination comprising a planar bottom and a concave axially rounded edge adjacent the planar bottom;

a first interface at a forward end of the body portion;

a second interface at a bottom end of the forward portion, the second interface of the forward portion is one of friction welded, inertia welded, and spin welded to the first interface of the body portion; and a transition member comprising a second frustoconical forward portion, a second rearward portion subjacent the second frustoconical forward portion, and one of a generally cylindrical second bore and a tapered second bore axially extending from a forward end of the transition member through the second frustoconical forward portion to a second bore termination disposed within the second rearward portion, the second rearward portion comprising a planar bottom and a sidewall extending from the second frustoconical forward portion to a convex rounded edge that extends from the planar bottom to the sidewall, the sidewall being one of a generally cylindrical sidewall and a tapered sidewall complementary shaped to the first bore of the forward portion, the transition member mounted within the first bore of the forward portion.

13. The tool of claim 12, further comprising:

a bit tip insert comprising a base including one of a generally cylindrical sidewall and a tapered sidewall complementary shaped to the second bore of the transition member, the base of the bit tip insert adapted to be mounted within the second bore of the transition member.

14. The tool of claim 13, further comprising:

a frustoconical portion adjacent a distal end of the base of the bit tip insert, the frustoconical portion complementary shaped to the second bore termination.

15. The tool of claim 13, wherein the base of the bit tip insert is made of tungsten carbide.

16. The tool of claim 13, further comprising:

a tip adjacent a forward end of a sidewall of the base of the bit tip insert, the tip comprising an overlay including at least one of a polycrystalline diamond, industrial diamond, natural diamond, polycrystalline diamond composite material, and polycrystalline diamond compact material.

17. The tool of claim 16, wherein the overlay comprises at least one of:

at least one coating on an outer surface of the tip; and at least one layer on an outer surface of the tip.

18. The tool of claim 16, wherein the overlay of the tip is formed by a high pressure high temperature (HPHT) process.

19. The tool of claim 12, wherein the transition member includes one of a planar and tapered forward end.

20. The tool of claim 12, wherein the transition member is made of tungsten carbide.

21. The tool of claim 12, further comprising:

a frustoconical portion subjacent the forward end of the forward portion, the frustoconical portion axially extending from the forward end to a base adjacent the distal end of the forward portion.

22. A tool comprising:

a body portion and a generally cylindrical shank depending axially from the body portion;

a forward portion integrally attached to the body portion, the forward portion comprising a generally cylindrical portion extending axially from a planar bottom of the forward portion;

a first interface at a forward end of the body portion, the first interface including a first diameter;

a second planar interface extending diametrically across the bottom of the forward portion to the generally cylindrical portion of the forward portion, the second planar interface including a second diameter equal to the first diameter, the second planar interface of the forward portion is one of friction welded, inertia welded, and spin welded to the first interface of the body portion; and one of a generally cylindrical bore and a tapered bore axially extending from a forward end of the forward portion to a bore termination disposed within the forward portion, a bit tip insert comprising a base including one of a generally cylindrical sidewall and a tapered sidewall complementary shaped to the bore of the forward portion, the base of the bit tip insert adapted to be mounted within the bore of the forward portion.

23. The tool of claim 22, further comprising:

a frustoconical portion adjacent a distal end of the base of the bit tip insert, the frustoconical portion complementary shaped to the bore termination.

24. The tool of claim 22, wherein the base of the bit tip insert is made of tungsten carbide.

25. The tool of claim 22, further comprising:

a tip adjacent a forward end of a sidewall of the base of the bit tip insert, the tip comprising an overlay including at least one of a polycrystalline diamond, industrial diamond, natural diamond, polycrystalline diamond composite material, and polycrystalline diamond compact material.

26. The tool of claim 25, wherein the overlay comprises at least one of:

at least one coating on an outer surface of the tip; and at least one layer on an outer surface of the tip.

27. The tool of claim 22, wherein an overlay of the bit tip insert is formed by a high pressure high temperature (HPHT) process.

28. The tool of claim 22, further comprising:

at least one of a first plurality of circumferentially spaced protrusions disposed on the sidewall of the base adjacent a forward end of the base of the bit tip insert and a second plurality of circumferentially spaced protrusions disposed on the sidewall of the base adjacent a rearward end of the base of the bit tip insert.

29. A tool comprising:

a body portion and a generally cylindrical shank depending axially from a bottom of the body portion, the body portion comprising one of a generally cylindrical first bore and a tapered first bore axially extending from a forward end of the body portion to a first bore termination disposed within the body portion, the first bore termination comprising a planar bottom and a concave axially rounded edge adjacent the planar bottom; and a transition member comprising a planar forward end, a base axially extending from the planar forward end, and a second bore axially extending from the planar forward end of the transition member to a second bore termination disposed within the base, the base comprising a flat bottom and a sidewall extending from the planar forward end to a convex rounded surface between the flat bottom and the sidewall of the transition member, the sidewall of the transition member being one of a generally cylindrical sidewall and a tapered sidewall complementary shaped to the first bore of the body portion, the transition member adapted to be mounted within the first bore of the body portion.

30. The tool of claim 22, further comprising:

a frustoconical portion axially extending from the forward end of the forward portion, the frustoconical portion adjacent the generally cylindrical portion of the forward portion.

31. The tool of claim 30, one of the generally cylindrical bore and the tapered bore of the forward portion disposed within the frustoconical portion of the forward portion.

32. The tool of claim 29, further comprising:

a bit tip insert comprising a base including one of a generally cylindrical sidewall and a tapered sidewall complementary shaped to the second bore of the transition member, the base of the bit tip insert adapted to be mounted within the second bore of the transition member.

33. The tool of claim 32, further comprising:

a frustoconical portion adjacent a distal end of the base of the bit tip insert, the frustoconical portion complementary shaped to the second bore termination.

34. The tool of claim 32, wherein the base of the bit tip insert is made of tungsten carbide.

35. The tool of claim 32, further comprising:

a tip adjacent a forward end of a sidewall of the base of the bit tip insert, the tip comprising an overlay including at least one of a polycrystalline diamond, industrial diamond, natural diamond, polycrystalline diamond composite material, and polycrystalline diamond compact material.

36. The tool of claim 35, wherein the overlay comprises at least one of:

at least one coating on an outer surface of the tip; and at least one layer on an outer surface of the tip.

37. The tool of claim 35, wherein the overlay of the tip is formed by a high pressure high temperature (HPHT) process.

38. The tool of claim 29, wherein the transition member is made of tungsten carbide.

* * * * *